US010125553B2

(12) United States Patent
Uhlenberg et al.

(10) Patent No.: US 10,125,553 B2
(45) Date of Patent: Nov. 13, 2018

(54) CORING TOOLS FOR MANAGING HYDRAULIC PROPERTIES OF DRILLING FLUID AND RELATED METHODS

(71) Applicant: Baker Hughes Incorporated, Houston, TX (US)

(72) Inventors: Thomas Uhlenberg, Niedersachsen (DE); Christian Fulda, Sehnde (DE)

(73) Assignee: Baker Hughes Incorporated, Houston, TX (US)

( * ) Notice: Subject to any disclaimer, the term of this patent is extended or adjusted under 35 U.S.C. 154(b) by 587 days.

(21) Appl. No.: 14/640,656

(22) Filed: Mar. 6, 2015

(65) Prior Publication Data

US 2016/0258223 A1 Sep. 8, 2016

(51) Int. Cl.

| | |
|---|---|
| ***E21B 10/60*** | (2006.01) |
| ***E21B 10/02*** | (2006.01) |
| ***E21B 10/48*** | (2006.01) |

(52) U.S. Cl.

CPC ..... *E21B 10/605* (2013.01); *E21B 10/02* (2013.01); *E21B 10/48* (2013.01)

(58) Field of Classification Search

CPC ..... E21B 10/06; E21B 10/605

See application file for complete search history.

(56) References Cited

U.S. PATENT DOCUMENTS

| | | | | |
|---|---|---|---|---|
| 2,068,704 | A * | 1/1937 | Powell | E21B 10/66 175/259 |
| 4,551,758 | A | 11/1985 | Masunaga | |
| 4,981,183 | A | 1/1991 | Tibbitts | |
| 5,460,230 | A | 10/1995 | Dekoster | |
| 5,568,838 | A | 10/1996 | Struthers et al. | |
| 6,182,760 | B1 * | 2/2001 | Phelps | E21B 7/061 166/117.5 |
| 6,394,196 | B1 | 5/2002 | Fanuel et al. | |
| 7,055,626 | B2 | 6/2006 | Wells et al. | |
| 7,776,256 | B2 | 8/2010 | Smith et al. | |
| 7,802,495 | B2 | 9/2010 | Oxford et al. | |
| 8,459,381 | B2 | 6/2013 | Pearce et al. | |
| 2003/0173116 | A1 * | 9/2003 | Wells | E21B 10/48 175/404 |
| 2006/0169496 | A1 | 8/2006 | Puymbroeck et al. | |
| 2007/0261886 | A1 | 11/2007 | Wilson et al. | |

(Continued)

OTHER PUBLICATIONS

Uhlenberg et al., U.S. Appl. No. 14/274,495 entitled Coring Tools and Related Methods, filed May 9, 2014.

(Continued)

*Primary Examiner* — Giovanna C. Wright
*Assistant Examiner* — Manuel C Portocarrero
(74) *Attorney, Agent, or Firm* — TraskBritt

(57) ABSTRACT

A coring bit for use on a coring tool for extracting a sample of subterranean formation from a wellbore includes a bit body having a cavity, wherein a throat portion of the cavity extends into the bit body from a face of the bit body. The coring bit includes a sleeve disposed within the cavity of the bit body, the sleeve configured to separate a face discharge channel and a throat discharge channel. The face discharge channel is located radially outward of the sleeve and the throat discharge channel is located radially inward of the sleeve. A method of repairing a such a coring bit includes removing the sleeve from the cavity of a bit body.

19 Claims, 14 Drawing Sheets

(56) References Cited

U.S. PATENT DOCUMENTS

| | | | | |
|---|---|---|---|---|
| 2010/0089660 | A1 | 4/2010 | Pearce et al. | |
| 2011/0162892 | A1* | 7/2011 | Oothoudt | E21B 10/44 175/189 |
| 2011/0186288 | A1* | 8/2011 | Braddick | E21B 43/103 166/208 |
| 2013/0146366 | A1 | 6/2013 | Cheng et al. | |
| 2014/0216826 | A1 | 8/2014 | Pearce et al. | |
| 2014/0360792 | A1* | 12/2014 | Azar | E21B 10/62 175/432 |
| 2015/0021096 | A1 | 1/2015 | Wesemeier et al. | |
| 2015/0267492 | A1 | 9/2015 | Broussard, Jr. | |

OTHER PUBLICATIONS

International Search Report for International Application No. PCT/US2016/020974, dated Jun. 15, 2016, 3 pages.

International Written Opinion for International Application No. PCT/US2016/020974, dated Jun. 15, 2016, 9 pages.

* cited by examiner

CORING TOOLS FOR MANAGING HYDRAULIC PROPERTIES OF DRILLING FLUID AND RELATED METHODS

FIELD

The present disclosure relates generally to apparatuses and methods for taking core samples of subterranean formations. More specifically, the present disclosure relates to a core bit having features to control flow of drilling fluid into a narrow annulus between the core bit inside diameter and the outside diameter of an associated core shoe of a coring apparatus for reduction of drilling fluid contact with, and potential invasion and contamination of, a core being cut.

BACKGROUND

Formation coring is a well-known process in the oil and gas industry. In conventional coring operations, a core barrel assembly is used to cut a cylindrical core from the subterranean formation and to transport the core to the surface for analysis. Analysis of the core can reveal invaluable data concerning subsurface geological formations—including parameters such as permeability, porosity, and fluid saturation—that are useful in the exploration for and production of petroleum, natural gas, and minerals. Such data may also be useful for construction site evaluation and in quarrying operations.

A conventional core barrel assembly typically includes an outer barrel having, at a bottom end, a core bit adapted to cut the cylindrical core and to receive the core in a central opening, or throat. The opposing end of the outer barrel is attached to the end of a drill string, which conventionally comprises a plurality of tubular sections that extends to the surface. Located within, and releasably attached to, the outer barrel is an inner barrel assembly having an inner tube configured for retaining the core. The inner barrel assembly further includes a core shoe disposed at one end of the inner tube adjacent the throat of the core bit. The core shoe is configured to receive the core as it enters the throat and to guide the core into the inner tube. Both the inner tube and core shoe are suspended within the outer barrel with structure permitting the core bit and outer barrel to rotate freely with respect to the inner tube and core shoe, which may remain substantially rotationally stationary. Thus, as the core is cut—by application of weight to the core bit through the outer barrel and drill string in conjunction with rotation of these components—the core will traverse the throat of the core bit to eventually reach the core shoe, which accepts the core and guides it into the inner tube assembly where the core is retained until transported to the surface for examination.

Conventional core bits are generally comprised of a bit body having an annular face surface on a bottom end. The opposing end of the core bit is configured, e.g., by threads, for connection to the outer barrel. Located at the center of the face surface is the throat, which may extend into a substantially hollow cylindrical cavity formed in the bit body. Different types of core bits are known in the industry, such as, by way of non-limiting example, diamond bits, including polycrystalline diamond compact (PDC) bits as well as impregnated bits. In PDC bits, for example, the face surface typically includes a plurality of cutters arranged in a selected pattern. The pattern of cutters includes at least one outside gage cutter disposed near the periphery of the face surface that determines the diameter of the bore hole drilled in the formation during a coring operation. The pattern of cutters also includes at least one inside gage cutter disposed near the throat that determines the outside diameter of the core being cut. It is to be understood, however, that the scope of the present disclosure is not limited to PDC bits, but encompasses other core bit types as well.

During coring operations, a drilling fluid is usually circulated through the core barrel assembly to lubricate and cool the cutting structure of the bit face, such as the plurality of cutters disposed on the face surface of the core bit, and to remove formation cuttings from the bit face surface to be transported upwardly to the surface through the annulus defined between the drill string and the wall of the wellbore. A typical drilling fluid, also termed drilling "mud," may be a hydrocarbon, a water-based (saltwater or freshwater) or synthetic-based fluid in which fine-grained mineral matter may be suspended, or any other fluid suitable to convey the downhole formation cuttings to the surface. Some core bits include one or more ports or nozzles positioned to deliver drilling fluid to the face surface. Generally, a port includes a port outlet, or "face discharge outlet," which may optionally comprise a nozzle, at the face surface in fluid communication with a face discharge channel. The face discharge channel extends through the bit body and terminates at a face discharge channel inlet. Each face discharge channel inlet is in fluid communication with an upper annular region formed between the bit body and the inner tube and core shoe. Drilling fluid received from the drill string under pressure is circulated into the upper annular region to the face discharge channel inlet of each face discharge channel to draw drilling fluid from the upper annular region. Drilling fluid then flows through each face discharge channel and discharges at its associated face discharge port to lubricate and cool the plurality of cutters on the face surface and to remove formation cuttings as noted above.

In conventional core barrel assemblies, a narrow annulus exists in the region between the inside diameter of the bit body and the outside diameter of the core shoe. The narrow annulus is essentially an extension of the upper annular region and, accordingly, the narrow annulus is in fluid communication with the upper annular region. Thus, in addition to flowing into the face discharge channel inlets, the pressurized drilling fluid circulating into the upper annular region also flows into the narrow annulus between the bit body and core shoe, also referred to as a "throat discharge channel." The location at which drilling fluid bypasses the face discharge channel inlets and continues into the throat discharge channel may be referred to as the "flow split." The throat discharge channel terminates at the entrance to the core shoe proximate the face of the core bit and any drilling fluid flowing within its boundaries is exhausted proximate the throat of the core bit. As a result, drilling fluid flowing from the throat discharge channel will contact the exterior surface of the core being cut as the core traverses the throat and enters the core shoe.

Conventional core barrel assemblies are prone to damage core samples in various ways during operation. For example, core barrel assemblies may be prone to damage core samples by exposing the core to the flow of drilling fluid, particularly if the flow velocity is relatively high and the area of exposure is large. For example, a throat discharge channel through which drilling fluid is discharged with high velocity in the region where the core is exposed to the drilling fluid can create significant problems during coring operations, especially when coring in relatively soft to medium hard formations, or in unconsolidated formations. Drilling fluids discharged from the throat discharge channel enter an unprotected interval where no structure stands between such drilling fluids and the outer surface of the core as the core traverses the throat and enters the core shoe. Such drilling fluid can also invade and contaminate the core itself. For soft or unconsolidated formations, these drilling fluids invading the core may wash away, or otherwise severely disturb, the material of the core. The core may be so badly damaged by the drilling fluid invasion that standard tests for permeability, porosity, and other characteristics produce unreliable results, or cannot be performed at all. The severity of the negative impact of the drilling fluid on the core increases with the velocity of the drilling fluid in the unprotected interval. Fluid invasion of unconsolidated or fragmented cores is a matter of great concern in the petroleum industry as many hydrocarbon-producing formations, such as sand and limestone, are of the unconsolidated type. For harder formations, drilling fluid coming into contact with the core may still penetrate the core, contaminating the core and making it difficult to obtain reliable test data. Thus, limiting fluid invasion of the core can greatly improve core quality and recoverability while yielding a more reliable characterization of the drilled formation.

The problems associated with fluid invasion of core samples described above may be a result, at least in part, of the material comprising the bit body of a core barrel assembly. Conventional core bits often comprise hard particulate materials (e.g., tungsten carbide) dispersed in a metal matrix (commonly referred to as "metal matrix bits"). Metal matrix bits have a highly robust design and construction necessitated by the severe mechanical and chemical environments in which the core bit must operate. However, the dimensional tolerances of metal matrix core bits (including inner surface diameter, gap width of the throat discharge channel, TFA of the face discharge channels and depth of the junk slots) are limited by the strength of the metal matrix material. In such metal matrix core bits, portions of the bit body must exceed a minimal thickness necessary to maintain structural integrity and inhibit the formation of cracks or microfractures therein.

BRIEF SUMMARY

In some embodiments, a coring bit for use on a coring tool for extracting a sample of subterranean formation from a wellbore includes a bit body having a cavity, wherein a throat portion of the cavity extends into the bit body from a face of the bit body. The coring tool also includes a sleeve disposed within the cavity of the bit body. The sleeve is configured to separate at least one face discharge channel and a throat discharge channel. The at least one face discharge channel is located radially outward of the sleeve and the throat discharge channel is located radially inward of the sleeve.

In other embodiments, a method of repairing a coring tool for extracting a sample of subterranean formation from a wellbore includes removing a sleeve from a cavity of a bit body of the coring tool. The sleeve is configured to separate at least one face discharge channel and a throat discharge channel during operation of the coring tool. The at least one face discharge channel is located radially outward of the sleeve and the throat discharge channel is located radially inward of the sleeve.

BRIEF DESCRIPTION OF THE DRAWINGS

While the disclosure concludes with claims particularly pointing out and distinctly claiming specific embodiments, various features and advantages of embodiments of the disclosure may be more readily ascertained from the following description when read in conjunction with the accompanying drawings, in which:

DETAILED DESCRIPTION

Figure 1:
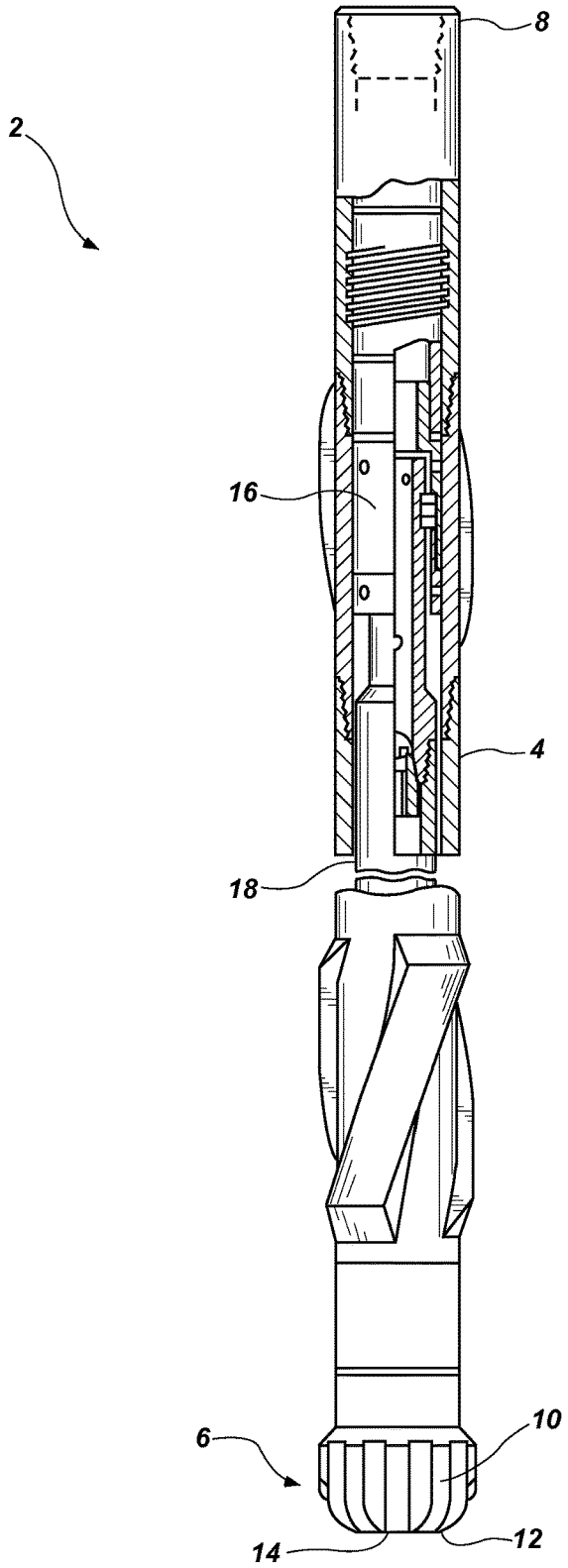
FIG. 1 illustrates a side, partially cut away plan view of a core barrel assembly for cutting a core sample from a subterranean formation.

The illustrations presented herein are not meant to be actual views of any particular core bit, shoe, or sleeve of a coring tool, or component thereof, but are merely idealized representations employed to describe illustrative embodiments. Thus, the drawings are not necessarily to scale.

The cited references cited herein, regardless of how characterized, are not admitted as prior art relative to the disclosure of the subject matter claimed herein.

As used herein, directional terms, such as "above," "below," "up," "down," "upward," "downward," "top," "bottom," "top-most," "bottom-most," "proximal" and "distal" are to be interpreted from a reference point of the object so described as such object is located in a vertical wellbore, regardless of the actual orientation of the object so described. For example, the terms "above," "up," "upward," "top," "top-most" and "proximal" are synonymous with the term "uphole," as such term is understood in the art of subterranean wellbore drilling. Similarly, the terms "below," "down," "downward," "bottom," "bottom-most" and "distal" are synonymous with the term "downhole," as such term is understood in the art of subterranean wellbore drilling.

As used herein, the term "longitudinal" refers to a direction parallel to a longitudinal axis of the core barrel assembly. For example, a "longitudinal" cross-section shall mean a "cross-section viewed in a plane extending along the longitudinal axis of the core barrel assembly."

As used herein, the terms "lateral," "laterally," "transverse" or "transversely" shall mean "transverse to a longitudinal axis of the core barrel assembly." For example, a "lateral" or "transverse" cross-section shall mean a cross-section viewed in a plane transverse to the longitudinal axis of the core barrel assembly.

Disclosed herein are embodiments of a core barrel assembly with increased effectiveness at reducing the exposure of the core sample to drilling fluid during a coring operation. Decreasing the amount and/or velocity of drilling fluid contacting the core sample may be accomplished by decreasing hydraulic losses, such as fluid flow resistance (also termed "head loss" or "resistance head") within the face discharge channels and increasing hydraulic losses within the throat discharge channel. Hydraulic losses of the various channels are at least partly a function of the Total Flow Area (TFA) along those channels. Thus, as set forth more fully in the embodiments disclosed below, the hydraulic losses of the face discharge channels may be reduced by increasing the TFA of the face discharge channels, while the hydraulic losses of the throat discharge channel may be increased by reducing the TFA or otherwise increasing the fluid flow resistance of the throat discharge channel. Reducing the hydraulic losses of the face discharge channels or increasing the hydraulic losses of the throat discharge channel may both result in an increase in drilling fluid being diverted from the throat discharge channel and instead flowing through the face discharge channels and away from the core. Such management of the hydraulic losses of the face discharge channels and the throat discharge channel may also reduce the velocity of drilling fluid exiting the throat discharge channel relative to prior art core bits. The maximum TFA of the face discharge channels is limited by the radial space of the bit body and the need to maintain minimum wall thicknesses within the bit body to prevent cracks or microfractures from forming therein. Additionally, the minimum TFA of the throat discharge channel is limited because a sufficient radial gap between an inner surface of the core bit and an outer surface of the core shoe is necessary to allow the core bit to rotate with respect to the core shoe without catching or binding therewith. Embodiments of a core barrel assembly that optimize fluid management therein by increasing the TFA of the face discharge channels and/or decreasing the TFA of the throat discharge channel and/or increasing flow restriction within the throat discharge channel are set forth below. The embodiments disclosed herein also improve the manufacturability and reparability of core bits.

FIG. 1 illustrates a core barrel assembly 2. The core barrel assembly 2 may include an outer barrel 4 having a core bit 6 disposed at a bottom end thereof. An upper end 8 of the outer barrel 4 opposite the core bit 6 may be configured for attachment to a drill string (not shown). The core bit 6 includes a bit body 10 having a face surface 12. The face surface 12 of the core bit 6 may define a central opening, or throat 14, that extends into the bit body 10 and is adapted to receive a core (not shown) being cut.

The bit body 10 may comprise steel or a steel alloy, including a maraging steel alloy (i.e., an alloy comprising iron alloyed with nickel and secondary alloying elements such as aluminum, titanium and niobium), and may be formed at least in part as further set forth in U.S. Patent Publication No. 2013/0146366 A1, published Jun. 6, 2013, to Cheng et al. (hereinafter "Cheng"), the disclosure of which is incorporated herein in its entirety by this reference. In other embodiments, the bit body 10 may be an enhanced metal matrix bit body, such as, for example, a pressed and sintered metal matrix bit body as disclosed in one or more of U.S. Pat. No. 7,776,256, issued Aug. 17, 2010, to Smith et al. and U.S. Pat. No. 7,802,495, issued Sep. 28, 2010, to Oxford et al., the disclosure of each of which is incorporated herein in its entirety by this reference. Such an enhanced metal matrix bit body may comprise hard particles (e.g., ceramics such as oxides, nitrides, carbides, and borides) embedded within a continuous metal alloy matrix phase comprising a relatively high strength metal alloy (e.g., an alloy based on one or more of iron, nickel, cobalt, and titanium). As a non-limiting example, such an enhanced metal matrix bit body may comprise tungsten carbide particles embedded within an iron, cobalt, or nickel based alloy. As a further non-liming example, such an enhanced metal matrix bit body may comprise a ceramic metal composite material including ceramic particles disposed in a continuous metal matrix. However, it is to be appreciated that the bit body 10 may comprise other materials as well, and any bit body material is within the scope of the embodiments disclosed herein, including materials formed by rapid prototyping processes.

Removably disposed inside the outer barrel 4 may be an inner barrel assembly 16. The inner barrel assembly 16 may include an inner tube 18 adapted to receive and retain a core for subsequent transportation to the surface. The inner barrel assembly 16 may further include a core shoe (not shown in FIG. 1) that may be disposed proximate the throat 14 for receiving the core and guiding the core into the inner tube 18. The core shoe is discussed in more detail below. The core barrel assembly 2 may include other features not shown or described with reference to FIG. 1, which have been omitted for clarity and ease of understanding. Therefore, it is to be understood that the core barrel assembly 2 may include many features in addition to those shown in FIG. 1.

Figure 2:
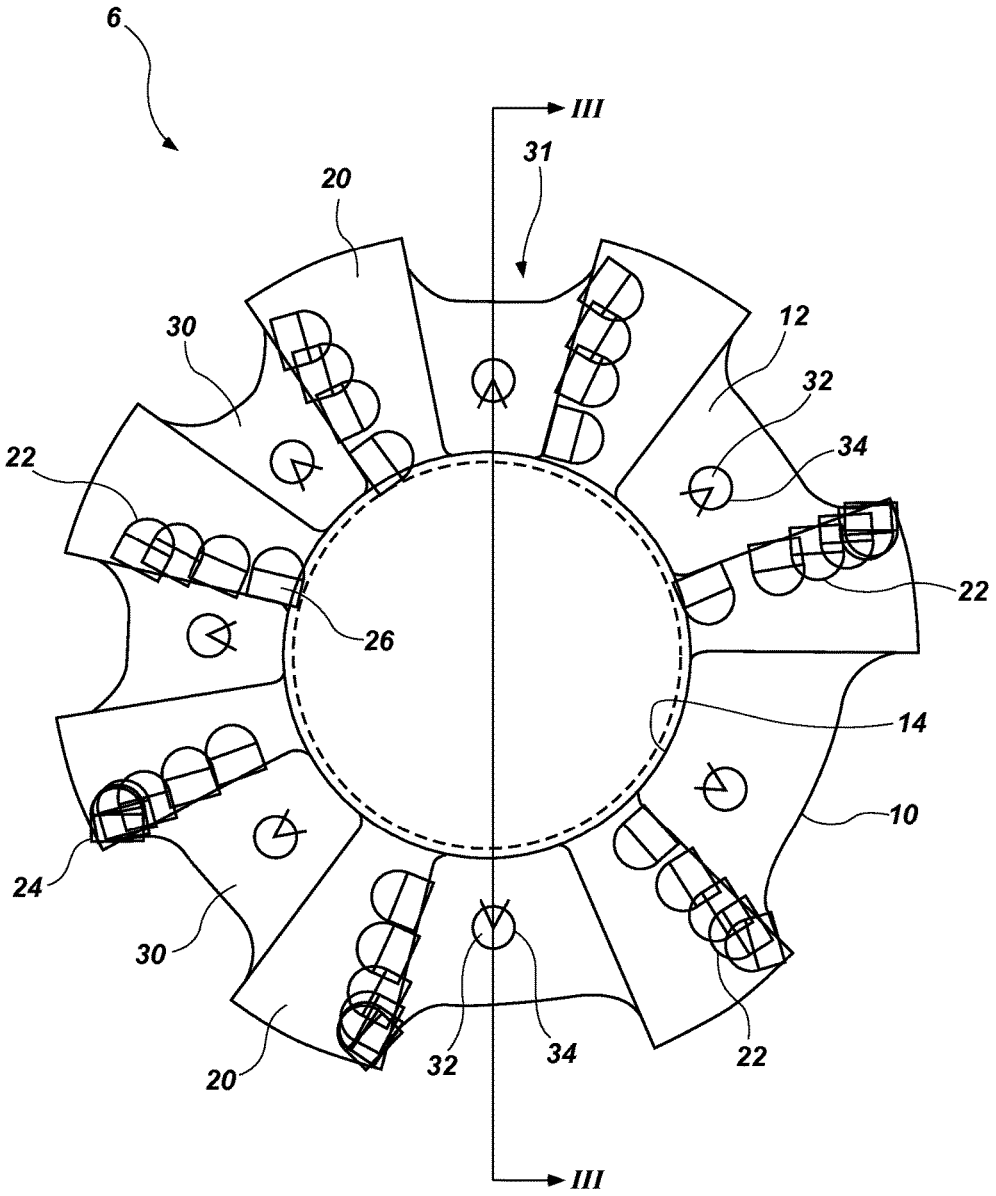
FIG. 2 illustrates a bottom, face view of a core bit of the core barrel assembly of FIG. 1.
Figure 3A:
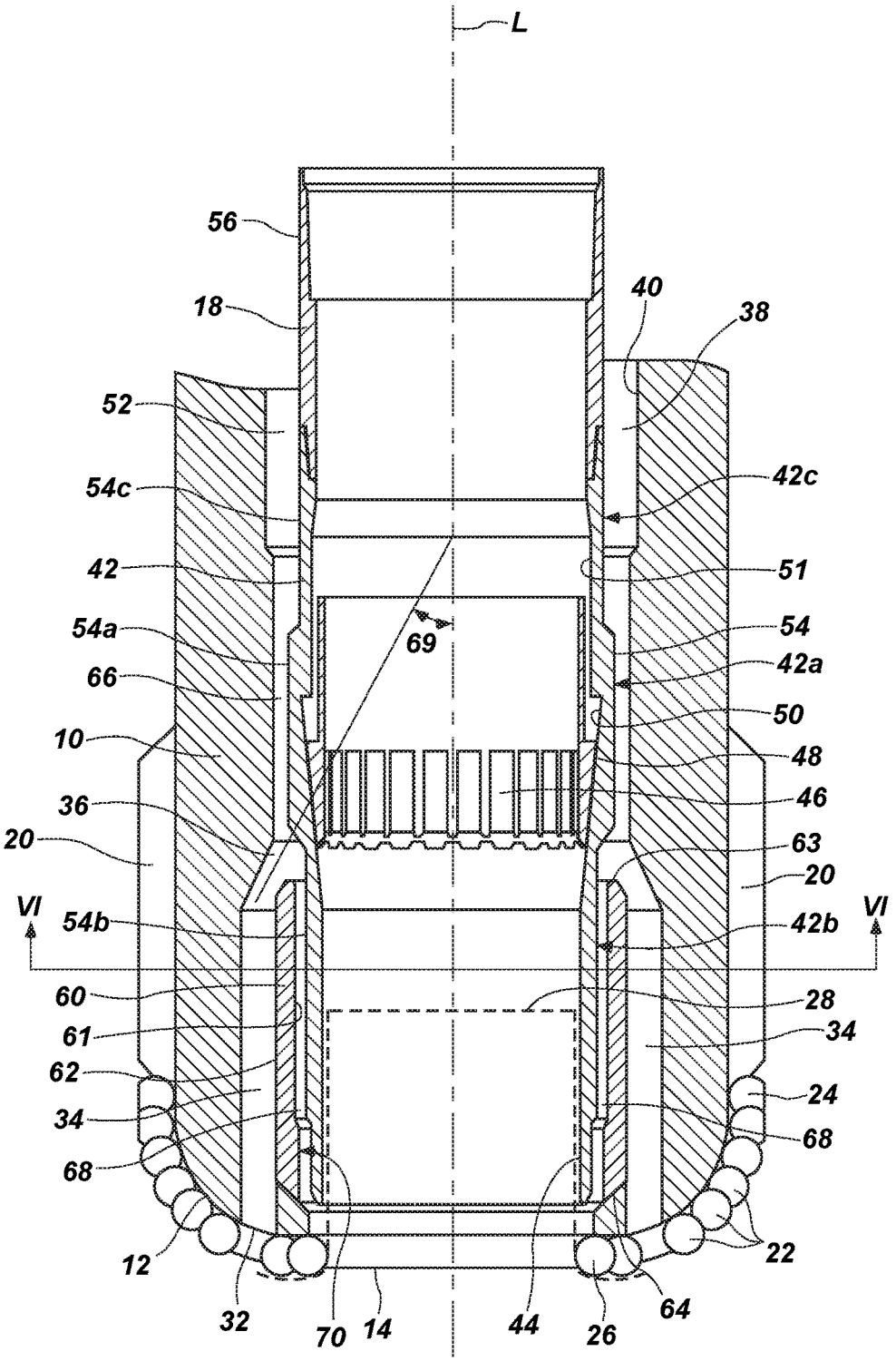
FIG. 3A illustrates a longitudinal cross-sectional view of the core bit and associated core shoe of FIGS. 1 and 2, taken along line of FIG. 2, including a sleeve affixed to the core bit, according to an embodiment of the present disclosure.
Figure 3B:
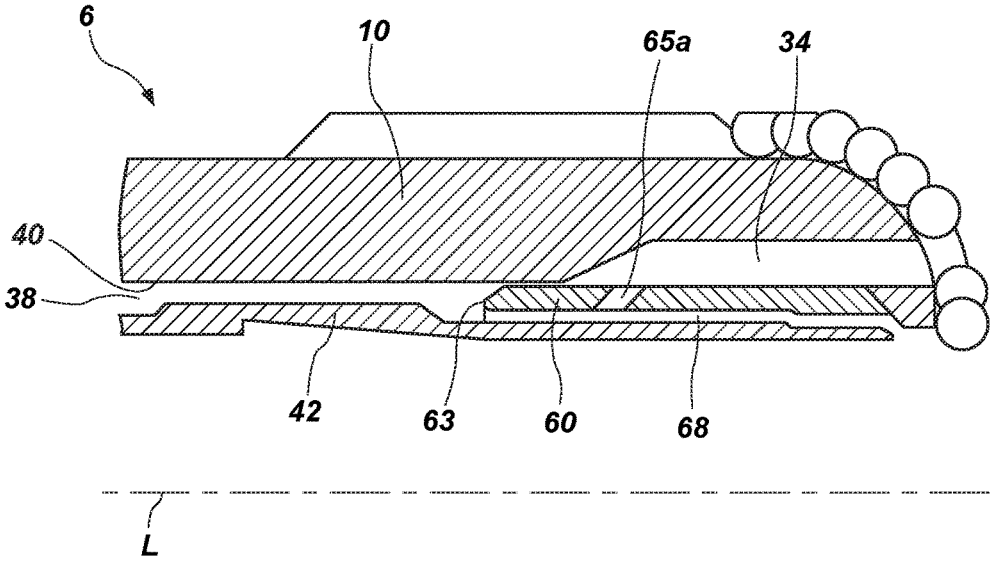
FIG. 3B illustrates a longitudinal cross-sectional view of sleeve having a fluid passage extending therethrough, according to an embodiment of the present disclosure.
Figure 3C:
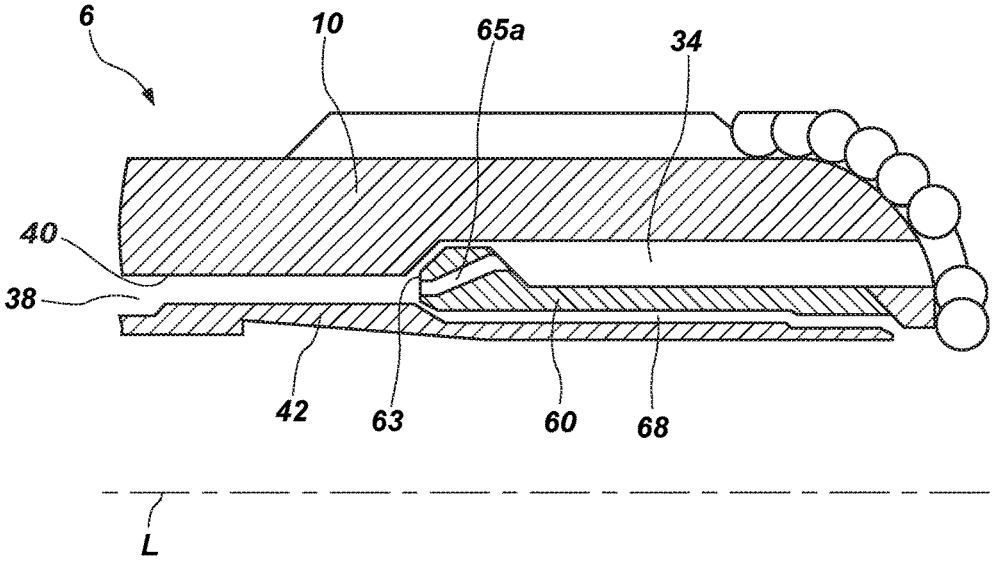
FIG. 3C illustrates a longitudinal cross-sectional view of sleeve having a fluid passage extending therethrough, according to an additional embodiment of the present disclosure.
Figure 4:
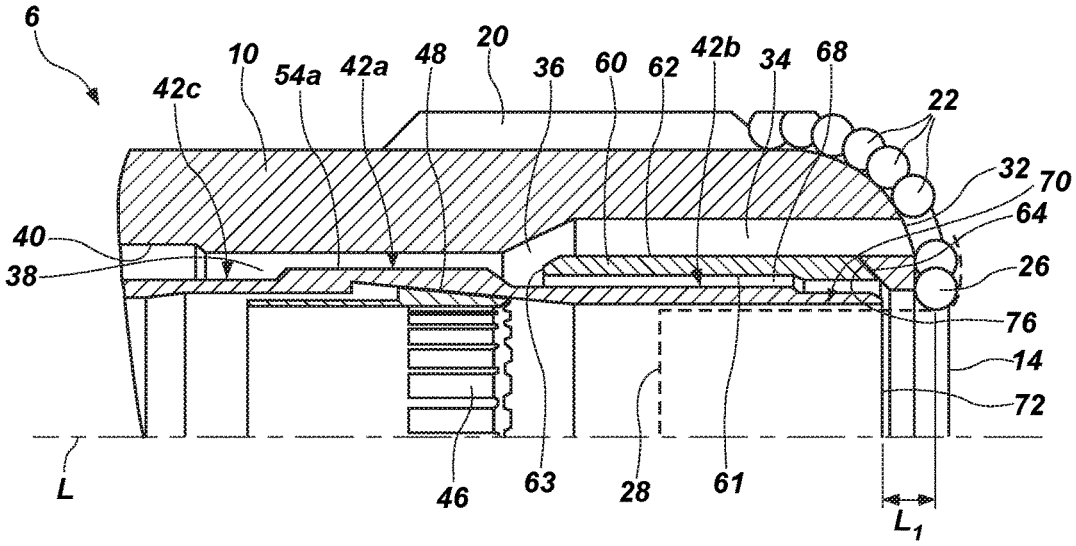
FIG. 4 illustrates a partial longitudinal cross-sectional view of the core bit and associated core shoe of FIG. 3A.
Figure 6:
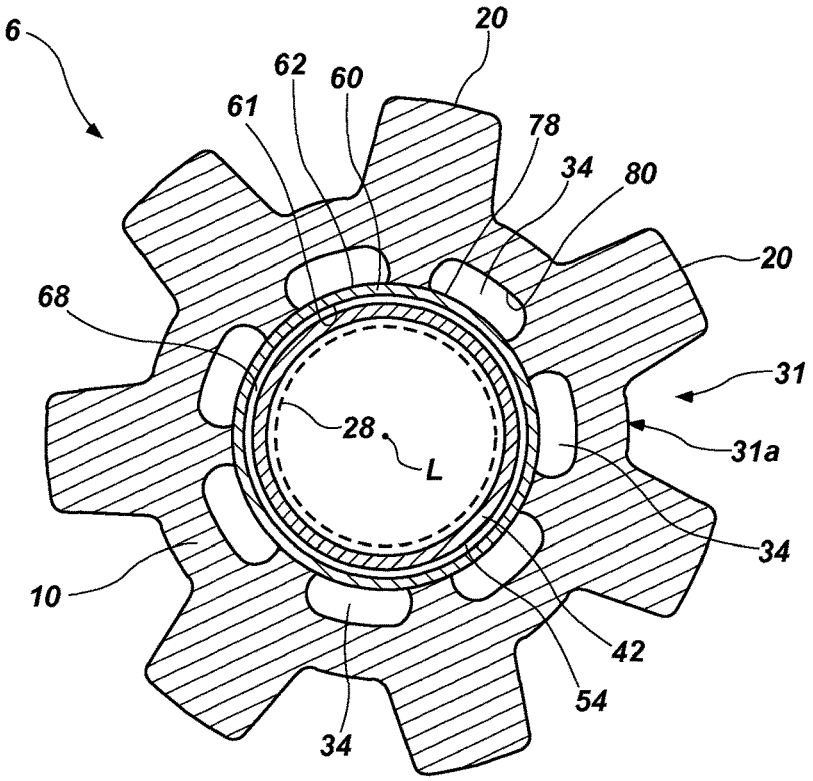
FIG. 6 illustrates a lateral cross-sectional view of the core bit and associated sleeve and core shoe of FIGS. 3A and 4, taken along line VI-VI of FIG. 3A.
Figure 7:
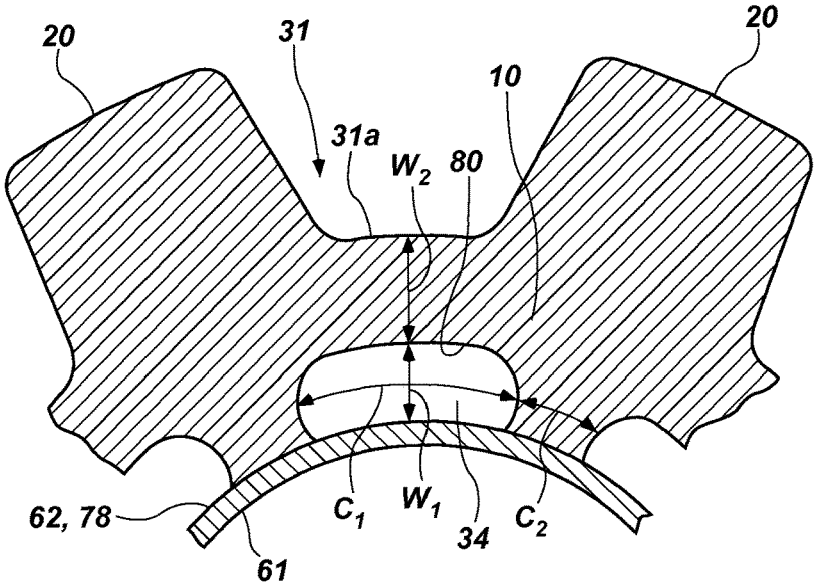
FIG. 7 illustrates a partial, magnified lateral cross-sectional view of the core bit and associated sleeve of FIG. 6.

FIGS. 2-4, 6 and 7 show additional views of the core bit 6 depicted in FIG. 1, according to various embodiments disclosed herein. FIG. 2 is a bottom view of the core bit 6; FIGS. 3 and 4 show longitudinal cross-sectional views of the core bit 6, as taken along line III-III of FIG. 2; FIG. 6 shows a lateral cross-sectional view of the core bit 6, as taken along line VI-VI of FIG. 3A; and FIG. 7 shows a magnified portion of the lateral cross-sectional view of FIG. 6.

As can be seen in FIG. 2, the throat 14 may open into the bit body 10 at the face surface 12. The bit body 10 may include a plurality of blades 20 at the face surface 12. A plurality of cutters 22 may be attached to the blades 20 and arranged in a selected pattern. The pattern of cutters 22 (shown longitudinally and rotationally superimposed one upon another along the bit profile in FIG. 2 and FIG. 3A, respectively) may include at least one outside gage cutter 24 that determines the diameter of the bore hole cut in the formation. The pattern of cutters 22 may also include at least one inside gage cutter 26 that determines the diameter of core 28 (shown by a dashed line) being cut and entering the throat 14. Radially extending fluid passages 30 may be formed on the face surface 12 between successive blades 20, which fluid passages 30 are contiguous with associated junk slots 31 on the gage of the core bit 6 between the blades 20. The face surfaces of the fluid passages 30 may be recessed relative to the blades 20. The bit body 10 may further include one or more face discharge outlets 32 for delivering drilling fluid to the face surface 12 to lubricate the cutters 22 during a coring operation.

Referring to FIG. 3A, each face discharge outlet 32 is in fluid communication with a face discharge channel 34 extending from the face discharge outlet 32 through the bit body 10 and inwardly terminating at a face discharge channel inlet 36. The bit body 10 may at least partially define or limit one or more face discharge channels 34 extending through the bit body 10 from associated face discharge channel inlets 36 to associated face discharge outlets 32 at the face surface 12 of the bit body 10. The face discharge channels 34 may be circumferentially spaced. However, in other embodiments, the bit body 10 may at least partially define as few as only one (1) annular face discharge channel 34 extending through the bit body 10 from a face discharge channel inlet 36 to the face surface 12 of the bit body 10. The bit body 10 may have an inner cavity 38 extending longitudinally therethrough and bounded by an inner surface 40 of the bit body 10. The cavity 38 may optionally be substantially cylindrical. The throat 14 opens into the cavity 38. At least a portion of at least one of the face discharge channels 34 may be defined or limited by at least a portion of the inner surface 40 of the bit body 10. The inner tube 18 may extend into the inner cavity 38 of the bit body 10. A core shoe 42 may be disposed at the lower end of the inner tube 18 and may be at least partially disposed within at least a portion of the bit body 10. As shown, the core shoe 42 may be a separate body coupled to the inner tube 18. However, in other embodiments, the core shoe 42 and the inner tube 18 may be integrally formed together. The inner tube 18 and the core shoe 42 may each be in the form of a tubular body, and each may be suspended so that the core bit 6 and the outer barrel 4 may freely rotate about the inner tube 18 and the core shoe 42. The core shoe 42 may have a central bore 44 configured and located to receive the core 28 therein as the core 28 traverses the throat 14 and to guide the core 28 into the inner tube 18. The core shoe 42 may be hardfaced to increase its durability.

A core catcher 46 may be carried by the core shoe 42 and may be housed within the central bore 44 of the core shoe 42. The core catcher 46 may comprise, for example, a wedging collet structure located within the core shoe 42. The core catcher 46 may be sized and shaped to enable the core 28 to pass through the core catcher 46 when traveling longitudinally upward into the inner tube 18. When the core barrel assembly 2 begins to back out of the wellbore, the outer surface of wedge-shaped portion 48 of the core catcher 46 comprising a number of circumferentially spaced collet fingers may interact with a tapered portion 50 of an inner surface 51 of the core shoe 42 to cause the collet fingers to constrict around and frictionally engage with the core 28, reducing (e.g., eliminating) the likelihood that the core 28 will exit the inner tube 18 after it has entered therein and enabling the core 28 to be fractured under tension from the formation from which the core 28 has been cut. The core 28 may then be retained in the inner tube 18 until the core 28 is transported to the surface for analysis. It is to be appreciated, however, that a core catcher is an optional feature of this disclosure and if a core catcher is used in conjunction with the disclosure it can be any type of core catcher known in the industry, such as but not limited to a spring-type catcher, collet catcher, flap catcher, full closure catcher, or any other appropriate catcher type known in the art. The catcher must at least partly interact with parts of the coring tool such as but not limited to the core shoe, the bit, a bit shank (not shown) to allow for catching the core when the coring tool is drawn.

An annular region 52 of the core barrel assembly 2 is located between the inner surface 40 of the bit body 10 and outer surfaces 54, 56 of the core shoe 42 and the inner tube 18, respectively. The annular region 52 forms a drilling fluid flow path extending longitudinally through the core barrel assembly 2 from a proximal end of the bit body 10 to the face discharge channel inlets 36. During a coring operation, drilling fluid is circulated under pressure into the annular region 52 such that drilling fluid can flow therefrom to the face surface 12 of the core bit 10, as described in more detail below. A flow diversion sleeve 60 may be disposed within the bit body 10. As shown in FIG. 3A, the sleeve 60 may be rigidly affixed to the inner surface 40 of the bit body 10. The sleeve 60 may have a radially inner surface 61 and a radially outer surface 62 extending from a longitudinal upper end 63, or "proximal end," of the sleeve 60 to a longitudinal bottom end 64, or "distal end," of the sleeve 60. The face discharge channels 34 may be located radially outward from the outer surface 62 of the sleeve 60. The upper end 63 of the sleeve 60 may define a portion of the face discharge channel inlets 36. In other embodiments, as shown in FIG. 3B, a portion of the upper end 63 of the sleeve 60 may abut a shoulder portion of the inner surface 40 of the bit body 10 and the sleeve 60 may define one or more fluid passages 65*a* extending through a portion of the sleeve 60 from the upper end 63 of the sleeve 60 to an associated face discharge channel 34. In yet other embodiments, as shown in FIG. 3C, one or more fluid passages 65*b* may extend laterally through an intermediate portion of the sleeve 60 to allow the fluid to flow from the inner cavity 38 to the face discharge channels 34. Referring to FIG. 3A, disposed proximate the upper end 63 of the sleeve 60 is an annular reservoir 66 between the adjacent inner surface 40 of the bit body 10 and the outer surface 54 of the core shoe 42. The annular region 52 and the annular reservoir 66 may be continuous with one another without any substantial flow restrictions therebetween. However, in other embodiments, the annular region 52 and the annular reservoir 66 may be distinct, separate annular regions, wherein the annular reservoir 66 is located below the annular region 52. For example, in such alternative embodiments, the annular region 52 and the annular reservoir 66 may be separated from one another by a portion of the bit body 10 extending radially inward in a manner to restrict flow between the annular region 52 and the annular reservoir 66.

With continued reference to FIG. 3A, a narrow annulus 68, also referred to as a "throat discharge channel," may be positioned longitudinally downward from the upper end 63 of the sleeve 60 and radially between the inner surface 61 of the sleeve 60 and the outer surface 54 of the core shoe 42. Drilling fluid circulating into the annular region 52 collects in the annular reservoir 66. In the embodiment of FIG. 3A, when the drilling fluid approaches the upper end 63 of the sleeve 60, the upper end 63 of the sleeve 60 splits the flow, with some drilling fluid flowing into the face discharge channel inlets 36 for delivery to the face surface 12 through the face discharge channels 34, while the remainder of the drilling fluid flows through the throat discharge channel 68 and exits through the throat 14. Thus, the upper end 63 of the sleeve 60 may be effectively termed a "flow split" in this embodiment. However, it is to be appreciated that, in other embodiments, the flow split may occur at other longitudinal locations. For example, in FIG. 3C, the flow split may occur at the fluid passages 65*b* extending through the intermediate portion of the sleeve 60. With continued reference to FIG. 3A, the throat discharge channel 68 may extend longitudinally from the flow split to the throat 14 of the bit body 10. The throat discharge channel 68 may also be said to extend longitudinally from the face discharge channel inlets 36 to the throat 14 of the bit body 10. The throat discharge channel 68 is essentially a smaller volume extension of, and in fluid communication with, the annular region 52. The throat discharge channel 68 includes a boundary profile 70 that defines the shape of the flow path in the throat discharge channel 68. Each channel inlet 36 may be oriented at an angle 69 to increase the hydrodynamic efficiency of the flow split, inducing more drilling fluid to bypass the throat discharge channel 68 and enter the face discharge channels 34. The channel inlets 36, the face discharge channels 34 and the throat discharge channel 68 may be configured to manage hydraulic losses therein to divert more drilling fluid through the face discharge channels 34, as described in more detail below.

A first portion 42*a* of the core shoe 42 may substantially surround the wedge-shaped portion 48 of the core catcher 46. The first portion 42*a* of the core shoe 42 may be located longitudinally between a second portion 42*b* and a third portion 42*c* of the core shoe 42, wherein the second portion 42*b* is located longitudinally below the first portion 42*a* and extends toward the face surface 12 of the core bit 6, with the third portion 42*c* located longitudinally above the first portion 42*a*. Because the first portion 42*a* of the core shoe 42 may at least partially surround the wedge-shaped portion 48 of the core catcher 46, an outer surface 54*a* of the first portion 42*a* may have a diameter greater than a diameter of an outer surface 54*b* of the second portion 42*b* and a diameter of an outer surface 54*c* of the third portion 42*c* of the core shoe 42; however, it is to be appreciated that the diameter of the outer surface 54*a* of the first portion 42*a* may be substantially equivalent to the diameter of the outer surface 54*c* of the third portion 42*c* in other embodiments. Because the second portion 42*b* of the core shoe 42 may have a diameter less than that of the first portion 42*a* of the core shoe 42, the second portion 42*b* may be termed a "narrow" portion of the core shoe 42 relative to the first portion 42*a* thereof.

The flow split may be located at the second, narrow portion 42*b* of the core shoe 42. Accordingly, the outer surface 54*b* of the second portion 42*b* of the core shoe 42 may define at least a portion of the throat discharge channel 68. Such a portion of the throat discharge channel 68 may be located radially inward from at least a portion of the inner surface 61 of the sleeve 60. Furthermore, such a portion of the throat discharge channel 68 may be defined by at least a portion of the inner surface 61 of the sleeve 60. The flow split may be located at the narrow portion 42*b* of the core shoe 42 to provide more radial space for the throat discharge channel 68, the face discharge channels 34, and the regions of the bit body 10 surrounding these channels to maintain minimum wall thicknesses throughout the bit body 10 to prevent cracks or microfractures from forming in the bit body 10 during use. The minimum wall thickness of various portions of the bit body 10 necessary to prevent cracks or microfractures from forming therein depends upon numerous factors, including, by way of non-limiting example, material composition and design of the bit body 10, the method(s) of forming the bit body 10, the subterranean formation material in which the bit body 10 is used, and other operational constraints. In other embodiments (not shown), the flow split may be longitudinally located at the first portion 42*a* or the third portion 42*c* of the core shoe 42.

Furthermore, in yet other embodiments (not shown), the diameter of the core shoe 42 may be substantially constant along the entire length of the core shoe 42.

Referring to FIG. 4, drilling fluid entering the throat discharge channel 68 will flow therethrough past a distal, lower-most end 72 of the core shoe 42 and exit the throat discharge channel 68 through the throat 14. The sleeve 60 may surround at least a lower portion of the core shoe 42. A longitudinal interval $L_1$ measured from the lower-most end 72 of the core shoe to a longitudinal midpoint of the inside gage cutter 26 may be termed an "unprotected interval" of the throat 14 because, once the drilling fluid has passed the lower-most end 72 of the core shoe 42, no structure stands between the drilling fluid and the core sample 28. Thus, in the unprotected interval $L_1$, drilling fluid exiting the throat discharge channel 68 may contact, and thereby invade and contaminate, the core sample 28 as the core 28 traverses the throat 14 and enters the core shoe 42.

The sleeve 60 may be rigidly attached to an inner surface 40 of the bit body 10. The sleeve 60 may comprise an erosion-resistant material such as, by way of non-limiting example, cemented tungsten carbide. The bottom end 64 of the sleeve 60 may be beveled and may be affixed to a mating portion 76 of the inner surface 40 of the bit body 10. In the embodiment of FIG. 4, the bottom end 64 of the sleeve 60 and the mating portion 76 of the bit body 10 are each shown as having corresponding beveled surfaces; however, it is to be appreciated that the bottom end 64 of the sleeve 60 and the mating portion 76 of the bit body 10 may have other configurations as well. With continued reference to FIG. 4, the outer surface 62 of the sleeve 60 may also be attached to portions of the inner surface 40 of the bit body 10 located circumferentially between adjacent face discharge channels 34. The sleeve 60 may be attached to the inner surface 40 of the bit body 10 by one or more of brazing, shrink fitting, adhesives, welding, or suitable mechanical fastening features. The sleeve 60 may also include a torque transmitting feature, such as circumferentially spaced keys extending into like-sized and spaced recesses in the inner surface 40 of the bit body 10, configured to prevent loosening of the sleeve 60 relative to the bit body 10, as may occur responsive to heat and/or friction experienced by the sleeve 60 or the bit body 10 adjacent the sleeve 60. The inner surface 61 of the sleeve 60 may define at least a portion of the boundary profile 70 of the throat discharge channel 68. Additionally, the outer surface 62 of the sleeve 60 may define at least a portion of the face discharge channels 34. As shown in FIG. 4, the sleeve 60 may form a barrier between the throat discharge channel 68 and the face discharge channels 34.

The outer surface 62 of the sleeve 60 may have a diameter less than a diameter of all portions of the inner surface 40 of the bit body 10 longitudinally upward of the longitudinal position at which the sleeve 60 is to be attached to the bit body 10 so that the sleeve 60 may be slid into place as a single, unitary body within the inner cavity 38 during assembly of the sleeve 60 within the bit body 10. Once the sleeve 60 is inserted into its final position where the bottom end 64 of the sleeve 60 abuts the mating portion 76 of the inner surface 40 of the bit body 10, the sleeve 60 may be rigidly affixed to the inner surface 40 of the bit body, as previously described.

Figure 5A:
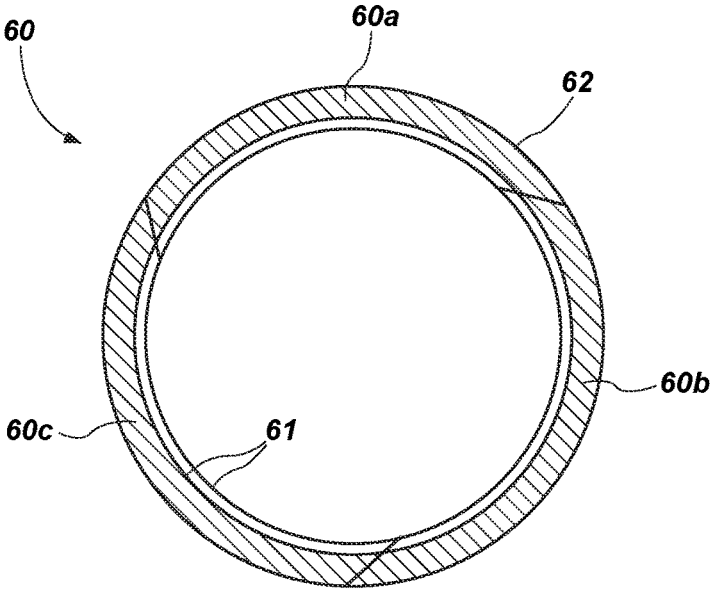
FIG. 5A illustrates a lateral cross-sectional view of a sleeve having three (3) separate sections, according to an embodiment of the present disclosure.
Figure 5B:
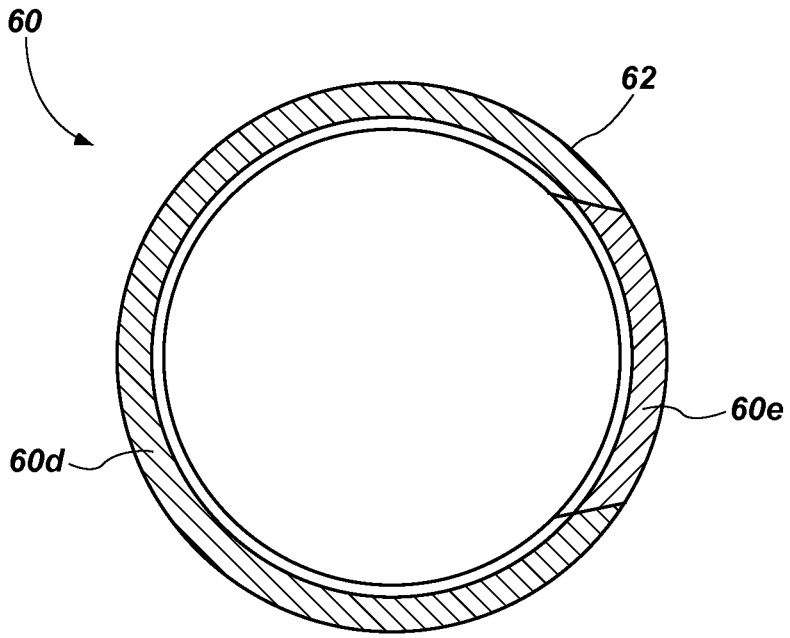
FIG. 5B illustrates a lateral cross-sectional view of a sleeve having two (2) separate sections, according to an embodiment of the present disclosure.

In other embodiments (not shown), the outer surface 62 of the sleeve 60 may have a diameter greater than a diameter of at least a portion (i.e., a "narrow" portion) of the inner surface 40 of the bit body 10 longitudinally upward of the longitudinal position at which the sleeve 60 is to be attached to the bit body 10. In such embodiments, the sleeve 60 may comprise two or more separate circumferential sections, such as the three separate circumferential sections 60*a*, 60*b*, 60*c* shown in FIG. 5A or the two separate circumferential sections 60*d*, 60*e* shown in FIG. 5B. Referring to FIG. 5A, each of the three separate circumferential sections 60*a*, 60*b*, 60*c* may have a maximum lateral dimension less than the diameter of the narrow portion of the inner surface 40 of the bit body 10. In such embodiments, the separate circumferential sections 60*a*, 60*b*, 60*c* may be individually inserted through the cavity 38 in the bit body 10 until each has cleared the narrow portion, and may subsequently be individually rigidly affixed to the inner surface 40 of the bit body 10 in their final positions to form the sleeve 60. In other embodiments, such as shown in FIG. 5B, the separate circumferential sections 60*d*, 60*e* may be temporary elastically deformed during the insertion to pass through the narrow portion. In the embodiments of FIGS. 5A and 5B, the separate circumferential sections 60*a*-60*e* of the sleeve 60 may be individually rigidly affixed to the inner surface 40 of the bit body 10 by brazing, adhesives, or mechanical fastening features. Alternatively, the separate circumferential sections 60*a*-60*e* of the sleeve 60 may be fitted together to form the sleeve 60 after they have cleared the narrow portion of the inner surface 40 of the bit body 10, and may subsequently be rigidly attached to the inner surface 40 of the bit body 10, as previously described. In still other embodiments, the sleeve 60 may not be affixed to the inner surface 40 of the bit body 10 and may be loosely held in place by the limited installation space within the bit body 10.

The sleeve 60 may be configured to be replaceable. For example, if the sleeve 60 becomes damaged or worn during use, or if access is needed to the face discharge channels 34 or associated channel inlets 36, the sleeve 60 may be detached from the bit body 10. In embodiments where the outer surface 62 of the sleeve 60 has a diameter less than a diameter of all portions of the inner surface 40 of the bit body 10 longitudinally upward of the longitudinal position at which the sleeve 60 is to be attached to the bit body 10, the sleeve 60 may be removed as a single body. Alternatively, the sleeve 60 may be separated into smaller pieces prior to its removal from the cavity 38 of the bit body 10. In embodiments where the outer surface 62 of the sleeve 60 has a diameter greater than a diameter of a narrow portion of the inner surface 40 of the bit body 10 located longitudinally upward of the longitudinal position at which the sleeve 60 is to be attached to the bit body 10, such as shown in FIG. 5A, the sleeve 60 may be separated into its separate circumferential sections 60*a*, 60*b*, 60*c* prior to its removal from the cavity 38 of the bit body 10. The separate circumferential sections may be temporarily elastically deformed during the removal to pass through the narrow portion. The sleeve 60 may be destructively separated into smaller pieces prior to removal in such embodiments as well. After the sleeve 60 has been removed, the sleeve 60 may be repaired, modified or reconfigured and subsequently reinserted and reattached to the inner surface 40 of the bit body 10, as previously described. In other embodiments, a replacement sleeve may be inserted into the bit body 10 in the same manner as previously described for the sleeve 60. It is to be appreciated that the replacement sleeve may be identical to the sleeve 60 or may have at least one feature different than that of the sleeve 60, as discussed in more detail below.

FIG. 6 illustrates a lateral cross-sectional view of the core bit 6 of FIGS. 1-4, taken along line VI-VI of FIG. 3A. The outer surface 62 of the sleeve 60 may define at least a portion of a radially inward surface 78 of some or all of the face discharge channels 34. The remaining surfaces 80 of the face discharge channels 34, which may be termed "radially outer surfaces," may be formed in the inner surface 40 of the bit body 10 to form, together with the outer surface 62 of the sleeve 60, the face discharge channels 34. Each of the face discharge channels 34 may have a non-circular shape, such as, for example, a generally elliptical shape, when viewed in a plane transverse to the direction of fluid flow through the face discharge channels 34, such as the lateral cross-sectional plane illustrated in FIG. 6. In other embodiments, each of the face discharge channels 34 may have a generally rectangular shape when viewed in a lateral cross-sectional plane. It is to be appreciated that the face discharge channels 34 may have other shapes when viewed in a lateral cross-sectional plane. It is also to be appreciated that at least one of the face discharge channels 34 may have a shape and cross-sectional area different than a shape of at least one other face discharge channel 34, when viewed in a lateral cross-sectional plane, and that the shape and/or the position of one or more of the face discharge channel 34 cross sections may vary along the longitudinal axis. By way of non-limiting example, a portion of about 40% or more of the longitudinal length of the at least one face discharge channel 34 may have a non-circular cross-sectional shape and the remaining portion may have a circular cross-sectional shape. The face discharge channels 34 may terminate at associated face discharge outlets 32, which may have lateral, cross-sectional shapes similar to those of the face discharge channels 34, or as shown in FIG. 1, may each be of a conventional, circular shape. Optionally, the face discharge outlets 32 and/or the face discharge channels 34 may include nozzles.

The face discharge channels 34 may be formed prior to attachment of the sleeve 60 to the bit body 10. Thus, in the absence of the sleeve 60, the face discharge channel inlets 36 and the radially outer surfaces 80 of the face discharge channels 34 may be machined into the bit body 10 at least partially from the cavity 38 of the bit body 10 (enabling the formation of face discharge channels 34 having non-circular shapes when viewed in a lateral cross-sectional plane) via machining methods, such as cutting, milling, grinding, eroding, abrading or other formation methods, such as casting, centrifugal casting, additive manufacturing or 3D printing. For example, an entire longitudinal extent of the face discharge channels 34, extending from the associated channel inlets 36 to associated outlets 32 at the face surface 12 of the bit body 10, may be formed in the bit body 10 from the cavity 38 of the bit body 10. However, in other embodiments, a portion less than an entire longitudinal extent of the face discharge channels 34 may be formed in the bit body 10 from the cavity 38 of the bit body 10.

FIG. 7 illustrates a magnified view of the core bit 10 and associated sleeve of FIG. 6. Because the face discharge channels 34 may be formed in the bit body 10 to have non-circular shapes when viewed in a lateral cross-sectional plane, the TFA of the face discharge channels 34 may be maximized by encompassing more of the circumferential space of the bit body 10. Such a configuration reduces the hydraulic losses within the face discharge channels 34, resulting in more drilling fluid bypassing the throat discharge channel 68 and instead flowing through the face discharge channels 34 and away from the core sample 28. The face discharge channels 34 may each have a maximum circumferential dimension $C_1$ greater than a maximum radial dimension $W_1$. The maximum radial dimension $W_1$ of the face discharge channels 34 may be maximized such that a minimum radial distance $W_2$, measured between a radially outward-most location of the outer surface 80 of the face discharge channels 34 and any radial inward-most surface 31*a* of the junk slots 31, approaches a minimum bit body 10 wall thickness required to resist formation of cracks or microfractures therein. Furthermore, the non-circular shape of the face discharge channels 34 allows the maximum circumferential dimension $C_1$ of each face discharge channel 34 to be maximized such that a minimum circumferential distance $C_2$ between adjacent face discharge channels 34 approaches the minimum bit body 10 wall thickness required to resist formation of cracks or microfractures therein. The sum of the maximum circumferential dimensions $C_1$ of the face discharge channels 34 may subtend an angle of at least about 50 degrees about a longitudinal axis L of the bit body 10 in a plane transverse to the longitudinal axis of the bit body 10. In other embodiments, the sum of the maximum circumferential dimensions $C_1$ of the face discharge channels 34 may subtend an angle between about 70 degrees and about 145 degrees about the longitudinal axis L of the bit body 10. In yet other embodiments, the sum of the maximum circumferential dimensions $C_1$ of the face discharge channels 34 may subtend an angle greater than about 145 degrees about the longitudinal axis L of the bit body 10. It is to be appreciated that the aforementioned plane transverse to the longitudinal axis of the bit body 10 is located longitudinally downward of the face discharge channel inlets 36, such that the angle subtended by the maximum circumferential dimensions $C_1$ of the face discharge channels 34 does not include the face discharge channel inlets 36. Additionally, one or more of the inner and outer surfaces 61, 62 of the sleeve 60 and the radially outer surfaces 80 of the face discharge channels 34 may be coated with a coating to reduce the effects of friction between such surfaces and the drilling fluid and/or to reduce the effects of erosion of the drilling fluid on such surfaces. By way of non-limiting example, one or more of the inner and outer surfaces 61, 62 of the sleeve 60 and the radially outer surfaces 80 of the face discharge channels 34 may have a layer of hardfacing material applied by a spray coating or a galvanic application, and may be heat treated or mechanically treated, such as by blasting or by hardening processes.

Additionally, the absence of the sleeve 60 during formation of the face discharge channel inlets 36 may allow easier access to the channel inlets 36 to be shaped non-cylindrically and/or have a varying diameter along a length thereof. For example, the face discharge channel inlets 36, similar to the face discharge channels 34 previously described in reference to FIG. 7, may have a maximum circumferential dimension greater than a maximum radial dimension to maximize the TFA of the face discharge channel inlets 36.

Additionally, because the sleeve 60 is replaceable and may be removed from the inner surface 40 of the bit body 10 after use, thereby providing access to the face discharge channels 34 from the cavity 38 of the bit body 10, the face discharge channels 34 and the associated channel inlets 36 may be repaired or otherwise modified after the core bit 6 has been used. For example, the face discharge channels 34 may be further processed and/or machined to reduce the surface friction of the surfaces thereof, to increase the TFA thereof, to change the transverse cross-sectional shape thereof, or to apply an erosion-resistant and/or friction-resistant coating to the surfaces thereof. The channel inlets 36 may be machined and or processed in a similar manner. Additionally, the channel inlets 36 may be machined to adjust the angle of approach of the channel inlets 36. Thus, the hydrodynamic efficiency of any of the flow split, the face discharge channels 34, and the throat discharge channel 68 may be repaired and/or improved after the core barrel assembly 2 has been used. Furthermore, while the replacement sleeve subsequently affixed to the inner surface 40 of the bit body 10 may be substantially identical to the original sleeve 60, in other embodiments, the replacement sleeve may differ from the original sleeve 60 in one or more properties, including, by way of non-limiting example, material composition, radial thickness, configuration of the upper end 63 forming part of the face discharge channel inlets 36, or surface features, such as those disclosed in more detail below. Thus, properties of the face discharge channels 34, the throat discharge channel 68, and the face discharge channel inlets 36 may be adjusted merely by replacing the sleeve 60. The choice of the sleeve 60 properties may be based on the experience with the sleeve that is to be replaced or the formation that was engaged or that is expected to be engaged downhole.

Figure 8A:
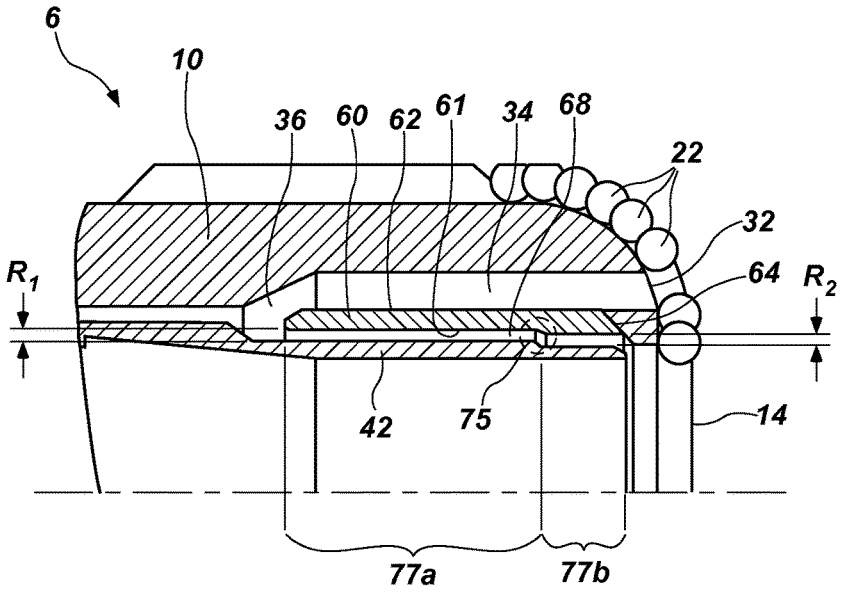
FIG. 8A illustrates a partial longitudinal cross-sectional view of a core bit and associated sleeve and core shoe, wherein the throat discharge channel includes a change in total flow area, according to an embodiment of the present disclosure.
Figure 8B:
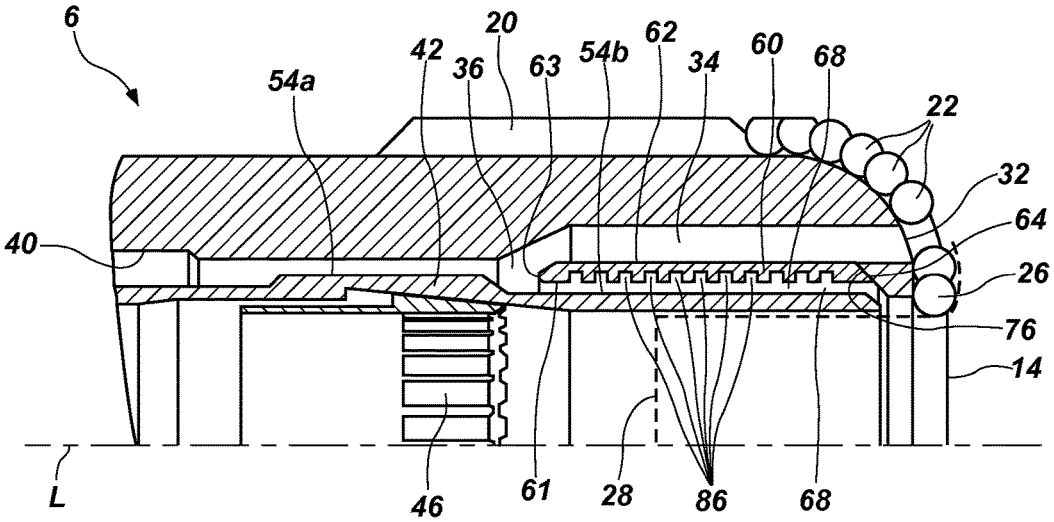
FIG. 8B illustrates a partial longitudinal cross-sectional view of a core bit and associated sleeve and core shoe, wherein the sleeve includes recesses formed in an inner surface thereof, according to an embodiment of the present disclosure.

FIGS. 8A and 8B illustrate a partial longitudinal cross-section view of a core bit 6 and associated sleeve 60 and core shoe 42 according to additional embodiments of the present disclosure. At least a portion of one or more of the outer surface 54*b* of the core shoe 42 and the inner surface 61 of the sleeve 60 defining the throat discharge channel 68 may further define a single TFA change or a series of consecutive TFA changes, also termed "stages," in the throat discharge channel 68. Each stage of the series of consecutive TFA changes in the throat discharge channel 68 may have a TFA, measured in a plane transverse to the general direction of fluid flow through the throat discharge channel 68, different than that of the immediately preceding and/or immediately succeeding stages in the general direction of fluid flow through the throat discharge channel 68. As shown in FIG. 8A, the throat discharge channel 68 may include a single stage, represented by a dashed circle 75, separating a first region 77*a* from a second, lower region 77*b* of the throat discharge channel 68. The stage 75 may be defined by the contour of the inner surface 61 of the sleeve 60 and the outer surface 54 of the core shoe 42 within the throat discharge channel 68. Optionally, a radial width $R_1$ of the throat discharge channel 68 within the first region 77*a* may be less than a radial width $R_2$ within the second region 77*b* of the throat discharge channel 68. In this manner, the narrower radial width $R_1$ of the first region 77*a* may restrict the flow of drilling fluid entering the throat discharge channel 68 and divert drilling fluid into the face discharge channels 34, while the wider radial width $R_2$ of the second region 77*b* of the throat discharge channel may provide an increase in TFA within the second region 77*b*, thereby reducing the velocity of drilling fluid flowing through and exiting the second region 77*b* and into the unprotected interval $L_1$, thus reducing damage to the core sample 28 (FIG. 4).

In the embodiment shown in FIG. 8B, the series of consecutive TFA changes may be in the form of a plurality of recesses 86 formed in the inner surface 61 of the sleeve 60. A TFA of the throat discharge channel 68 within the recesses 86 is greater than a TFA of the throat discharge channel 68 outside of the recesses 86. Each of the recesses 86 may be formed to extend annularly at least partly about a circumference of the inner surface 61 of the sleeve 60. However, it is to be understood that the recesses 86 may take other forms, shapes and configurations and may be combined with, or replaced by, recesses in the opposing outer surface of the core shoe 42, as described in more detail below. The recesses 86 may have a radial depth predetermined according to a number of factors, including, by way of non-limiting example, desired flow characteristics of drilling fluid through the throat discharge channel 68, material composition of the sleeve 60 and the radial wall thickness of the sleeve 60 between the inner and outer surfaces 61, 62 thereof. Additionally, the radial width of the throat discharge channel 68, measured from both inside and outside the recesses 86, may be tailored according to a number of factors, including, by way of non-limiting example, the composition, viscosity, density, a dispersion parameter, and/or the quality of the drilling fluid and rotational velocity of the core bit 6.

With continued reference to FIG. 8B, drilling fluid diverted into the throat discharge channel 68 will encounter the stages as it flows therethrough. For example, the drilling fluid will encounter stages at which the TFA therein increases (within the recesses 86) and decreases (between adjacent recesses 86). The consecutive stages also have the effect of inducing swirl in the drilling fluid and thus increasing the tortuosity and length of the flow path taken by the drilling fluid as it flows through the throat discharge channel 68. These effects increase the flow resistance within the throat discharge channel 68. Therefore, as the number of recesses 86 and/or the degree of difference in TFA between each stage is increased, the flow resistance across the throat discharge channel 68 is also increased. As the flow resistance across the throat discharge channel 68 is increased, the more the drilling fluid is restricted within the throat discharge channel 68, decreasing the amount of drilling fluid flowing into the throat discharge channel 68 while increasing the amount of drilling fluid flowing into the face discharge channels 34. In this manner, the amount of drilling fluid contacting the core 28 may be reduced. Moreover, this increased flow resistance across the throat discharge channel 68 may be accomplished while providing increased radial width of the throat discharge channel 68 over prior art coring bits, reducing the likelihood that particulates or debris within the drilling fluid become lodged between the outer surface 54 of the core shoe 42 and the inner surface 61 of the sleeve 60 within the throat discharge channel 68 in a manner to cause rotational friction between the bit body 10 and the core shoe 42, or worse, rotationally bind the core bit 6 to the core shoe 42 so that the core bit 6 cannot rotate relative to the core shoe 42, thus causing failure of the core barrel assembly 2.

Figure 9:
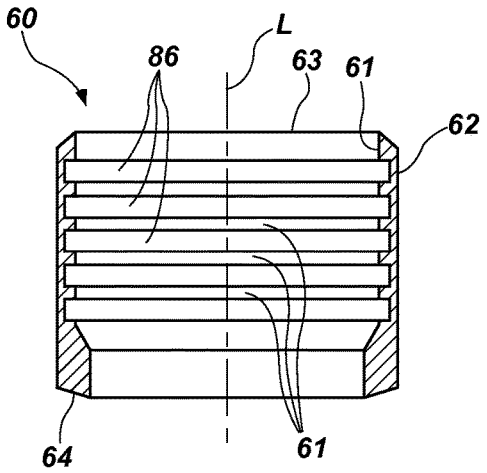
FIG. 9 illustrates a longitudinal cross-sectional view of a sleeve configured similar to the sleeve of FIG. 8B, wherein the sleeve has recesses that are rectangular in shape when viewed in a longitudinal cross-sectional plane and extend annularly about a circumference of an inner surface of the sleeve.
Figure 10:
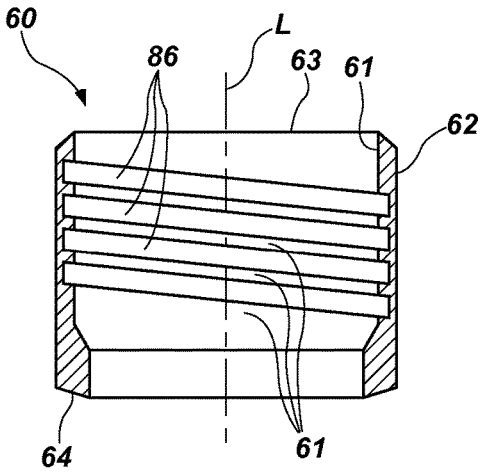
FIG. 10 illustrates a longitudinal cross-sectional view of a sleeve configured similar to the sleeve of FIG. 8B, wherein the recesses extend in a helical pattern about a circumference of the inner surface of the sleeve.
Figure 11:
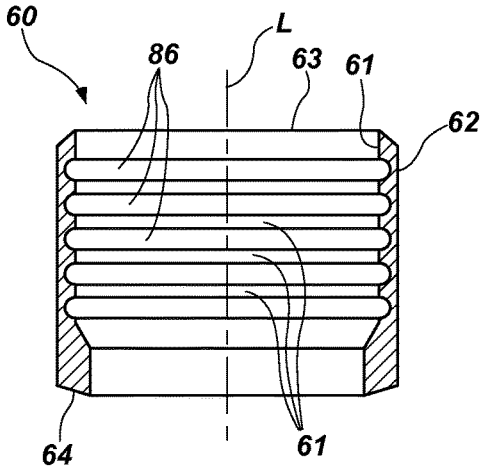
FIG. 11 illustrates a longitudinal cross-sectional view of a sleeve configured similar to the sleeve of FIG. 8B, wherein the recesses are arcuate in shape, when viewed in a longitudinal cross-sectional plane.
Figure 12:
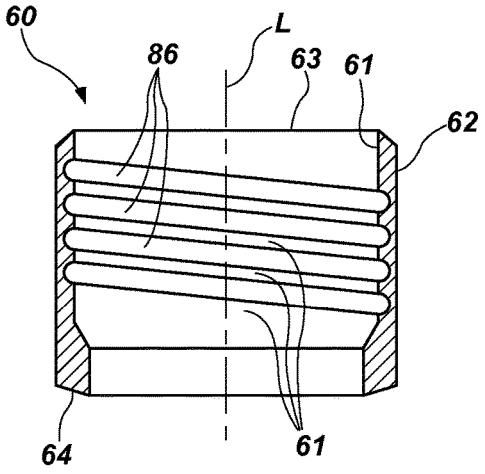
FIG. 12 illustrates a longitudinal cross-sectional view of a sleeve configured similar to the sleeve of FIG. 11, wherein the recesses extend in a helical pattern about a circumference of the inner surface of the sleeve.

FIGS. 9-12 illustrate cross-sectional views of various embodiments of the sleeve 60. As shown in FIG. 9, the recesses 86 formed in the inner surface 61 of the sleeve 60 may have a rectangular shape when viewed in a longitudinal cross-sectional plane. The recesses 86 may extend in an annular pattern about a circumference of the inner surface 61 of the sleeve 60. Alternatively, as shown in FIG. 10, the recesses 86 may extend in a helical pattern about the inner surface 61 of the sleeve 60. In other embodiments, as shown in FIG. 11, the recesses 86 formed in the inner surface 61 of the sleeve 60 may have an arcuate shape when viewed in a longitudinal cross-sectional plane. In yet other embodiments, the recesses 86 may have other shapes when viewed in a longitudinal cross-sectional plane. FIG. 12 illustrates recesses 86 having an arcuate shape in a longitudinal cross-sectional plane and extending in a helical pattern about the inner surface 61 of the sleeve 60.

Figure 13:
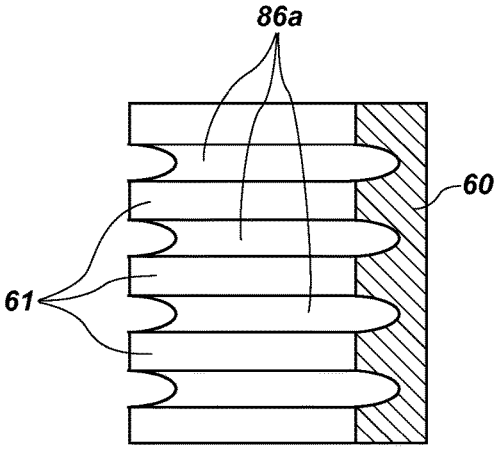
FIG. 13 illustrates a perspective view of a section of a sleeve having longitudinal recesses formed in an inner surface thereof, according to an embodiment of the present disclosure.
Figure 14:
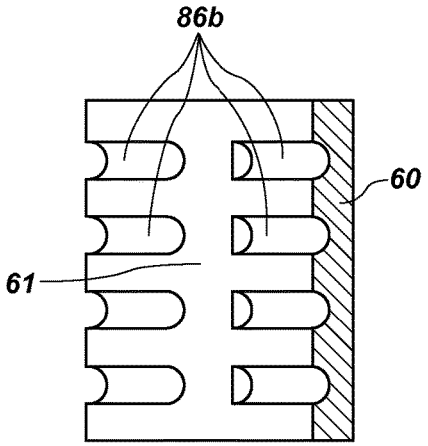
FIG. 14 illustrates a perspective view of a section of a sleeve having longitudinal recess segments formed in an inner surface thereof, according to an embodiment of the present disclosure.
Figure 15:
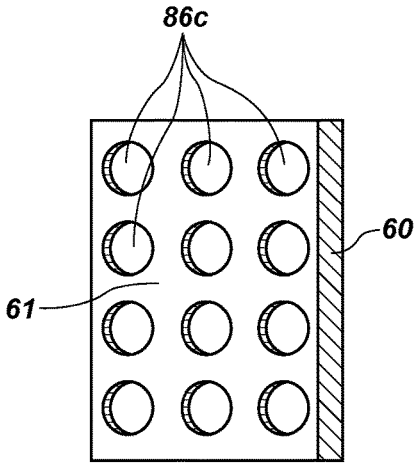
FIG. 15 illustrates a perspective view of a section of a sleeve having circular recesses formed in an inner surface thereof, according to an embodiment of the present disclosure.
Figure 16:
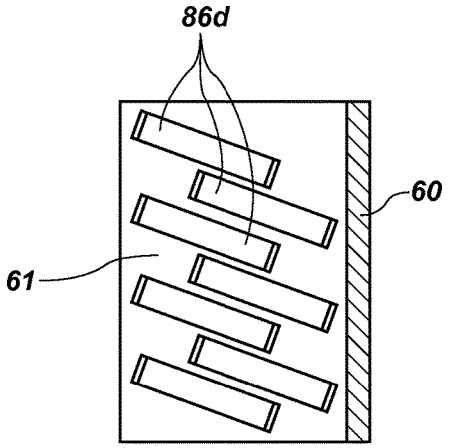
FIG. 16 illustrates a perspective view of a section of a sleeve having an array of rectangular pockets formed in an inner surface thereof, according to an embodiment of the present disclosure.

It is to be appreciated that FIGS. 8A-12 illustrate a limited number of examples of recesses 86 that may be employed to provide consecutive changes in TFA in the throat discharge channel 68. In other embodiments, the recesses 86 may have other shapes when viewed in a longitudinal cross-sectional plane. Additionally, recesses 86 may be formed in the outer surface 54*b* of the core shoe 42 in the throat discharge channel 68. In yet other embodiments, recesses 86 may be formed in the outer surface 54*b* of the core shoe 42 and the inner surface 61 of the sleeve 60 within the throat discharge channel 68. In further embodiments, the recesses 86 may be in the form of circumferentially extending channels 86*a*, as shown in FIG. 13. In additional embodiments, the recesses 86 may be in the form of circumferentially extending channel segments 86*b*, as shown in FIG. 14. In other embodiments, the recesses 86 may be in the form of an array of circular pockets 86*c*, as shown in FIG. 15. In yet other embodiments, the recesses 86 may be in the form of an array of skewed rectangular pockets 86*d*, as shown in FIG. 16. It is to be appreciated that the shape, form, orientation and/or configuration of the recesses 86 is not limited by this disclosure.

Furthermore, in other embodiments, the series of consecutive TFA changes may be provided by forming a plurality of protrusions extending radially inward from the inner surface 61 of the sleeve 60 and/or radially outward from the outer surface 54*b* of the core shoe 42 in the throat discharge channel 68. Such protrusions may be effectively configured as an inverse of any of the "recesses" 86-86*d* previously described, and may have other configurations as well. In yet other embodiments, the series of consecutive TFA changes may include a combination of recesses 86 and protrusions formed on or in the inner surface 61 of the sleeve 60 and/or the outer surface 54*b* of the core shoe 42 in the throat discharge channel 68. Additionally, at least one of the recesses 86 and/or protrusions may vary in shape, form, orientation and/or configuration from at least one other recess 86 and/or protrusion.

It is to be appreciated that the throat discharge channel 68 may include any number of TFA changes provided by recesses 86 and/or protrusions formed on and/or in the inner surface 61 of the sleeve 60 and the outer surface 54*b* of the core shoe 42 located within the throat discharge channel 68. For example, in the embodiment shown in FIG. 8B, the throat discharge channel 68 has at least twenty-two (22) TFA changes therein caused by the presence of eleven (11) recesses 86 formed in the inner surface 61 of the sleeve 60. However, in other embodiments, other quantities of TFA changes may be appropriate or better suited for the throat discharge channel 68. It is to be appreciated that the maximum number of TFA changes in the throat discharge channel is virtually unlimited.

Figure 17:
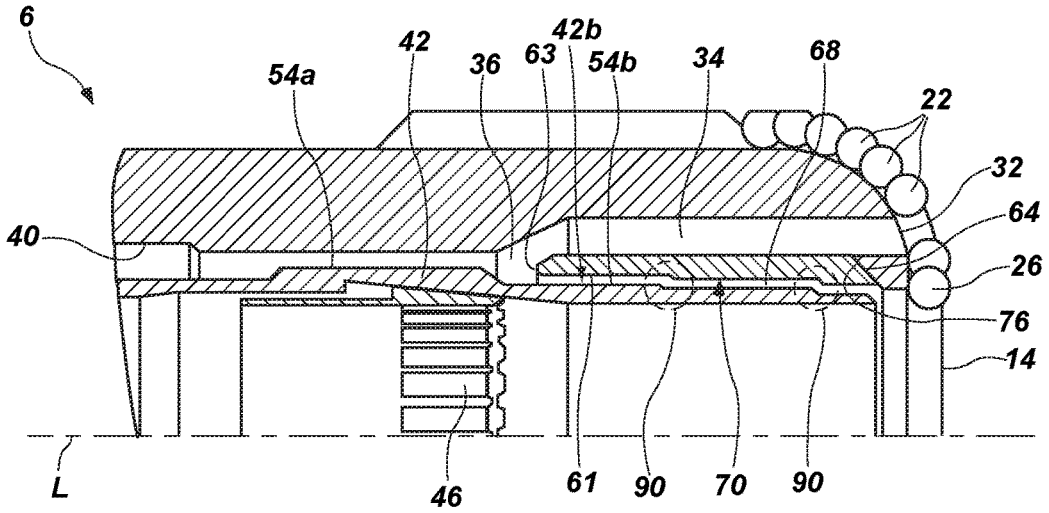
FIG. 17 illustrates a partial longitudinal cross-sectional view of a core bit and associated sleeve and core shoe, wherein the inner surface of the sleeve and the outer surface of the core shoe include variations in diameter in the direction of fluid flow therethrough, according to an embodiment of the present disclosure.

FIG. 17 illustrates an additional embodiment of a series of the consecutive TFA changes designed to increase flow resistance through the throat discharge channel 68. The throat discharge channel 68 boundary profile 70 includes two (2) stages, indicated by dashed circles 90, at which the outer surface 54*b* of the second portion 42*b* of the core shoe 42 and the inner surface 61 of the sleeve 60 decrease in diameter in the direction of fluid flow. It is to be appreciated, however, that virtually any number of such stages may be included. These stages 90 force the drilling fluid to increase its flow path and create, in some instances, swirl as the drilling fluid flows through each stage 90 relative to a similar flow path without any such stages. These factors increase the hydraulic losses in the throat discharge channel 68 by increasing the flow resistance encountered by the drilling fluid therein, thus restricting fluid flow within the throat discharge channel 68 and increasing fluid flow diverted through the face discharge channels 34, as previously described. Additionally, at least parts of the inner surface 61 of the sleeve 60 or the outer surface 54*b* of the core shoe 42 may be coated with a coating to increase the friction between the drilling fluid and at least one of sleeve 60 and the core shoe 42 and thereby increase the hydraulic losses within the fluid.

Figure 18:
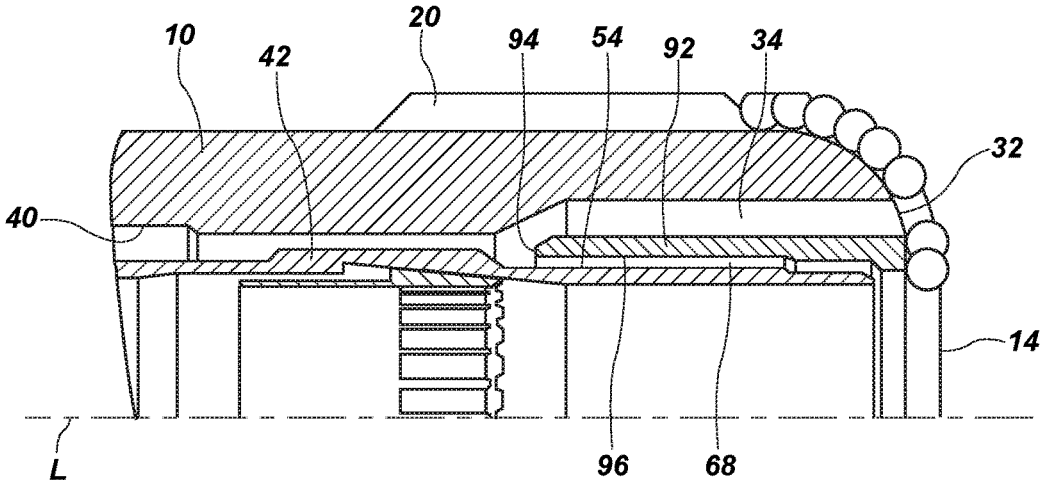
FIG. 18 illustrates a partial longitudinal cross-sectional view of a core bit and associated core shoe, wherein an integral portion of the bit body is located radially between face discharge channels and a throat discharge channel of the core bit, according to an embodiment of the present disclosure.
Figure 19:
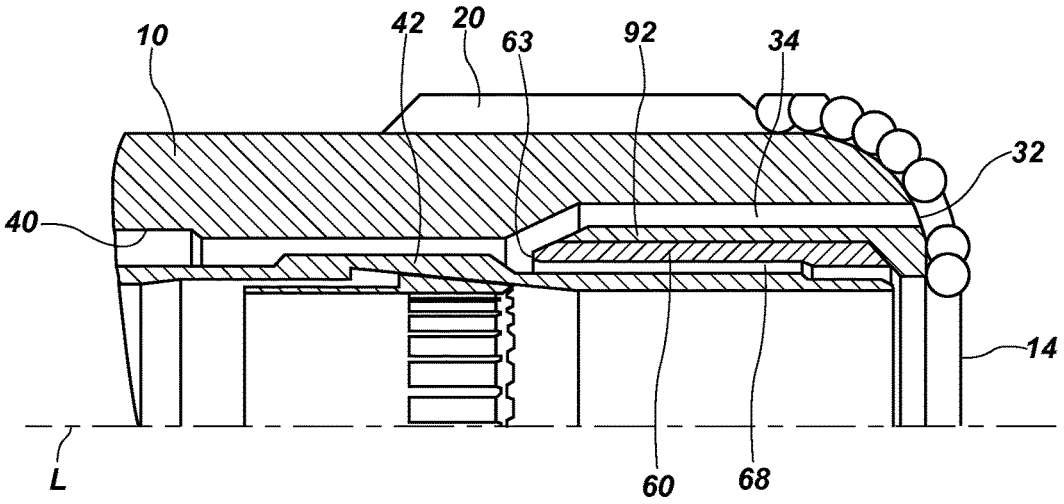
FIG. 19 illustrates a partial longitudinal cross-sectional view of a core bit and associated sleeve and core shoe, wherein the sleeve and an integral portion of the bit body are located radially between face discharge channels and a throat discharge channel of the core bit, according to an embodiment of the present disclosure.

It is to be appreciated that, while FIGS. 3-8B and 17 illustrate a sleeve 60 located radially between the face discharge channels 34 and the throat discharge channel 68, in other embodiments, the sleeve 60 may be omitted. In such embodiments, as shown in FIG. 18, the radial and longitudinal space occupied by the sleeve 60 in other embodiments may instead be occupied by an integral portion 92 of the bit body 10. The integral portion 92 of the bit body 10 may have a generally cylindrical configuration. A longitudinal uppermost end 94 of the integral portion 92 of the bit body 10 may define a portion of the face discharge channel inlets 36. An inner surface 96 of the integral portion 92 of the bit body 10 may define a radially outer surface of the throat discharge channel 68, and may be located radially inward of the face discharge channels 34. The inner surface 96 of the integral portion 92 of the bit body 10 and the outer surface 54 of the core shoe 42 may additionally include features for restricting flow of drilling fluid within the throat discharge channel 68, including all the features disclosed in relation to FIGS. 8A-17. For example, the inner surface 96 of the integral portion 92 and/or the outer surface 54 of the core shoe 42 in the throat discharge channel 68 may include recesses formed therein and/or protrusions formed thereon to restrict drilling fluid in the throat discharge channel 68, as previously described. Additionally, the throat discharge channel 68 boundary profile may include one or more stages at which the outer surface 54 of the core shoe 42 and the inner surface 96 of the integral portion 92 abruptly decrease in diameter in the direction of fluid flow to restrict flow of drilling fluid in the throat discharge channel 68, as previously described. In further embodiments, as shown in FIG. 19, a sleeve 60 and an integral portion 92 of the bit body 10 may be located between the face discharge channels 34 and the throat discharge channel 68. In such an embodiment, the integral portion 92 of the bit body 10 may be less than fully circumferential. For example, in such an embodiment, the integral portion 92 of the bit body 10 may be in the form of one or more guide blocks, as further described below.

In embodiments where the sleeve 60 is omitted, the face discharge channels 34 and the associated channel inlets 36, may be formed to have non-circular shapes in a transverse cross-sectional plane in a manner alternative to being machined from the cavity 38 of the bit body 10. By way of non-limiting example, for metal bit bodies, such as steel bit bodies, the bit body may be formed by a centrifugal die casting process, as set forth in U.S. Patent Publication No. 2013/0146366 A1, published Jun. 6, 2013, to Cheng et al. In such processes, metal material may be introduced into a die that defines the shape of the bit body to be formed, including the face discharge channels 34 and associated channel inlets 36. The die is heated and rotated to generate centrifugal forces on the heated metal to cause the metal to conform to the die shape. The die is subsequently cooled, and the formed bit body is removed from the die. Alternatively, for steel bit bodies, the face discharge channels having non-circular shapes in a lateral plane may be machined from the face surface 12 of the bit body 10. For metal-matrix bit bodies, which may be extremely difficult, if not virtually impossible, to machine in a practical sense, the bit body having face discharge channels with non-circular shapes in a lateral cross-sectional plane may be formed by placing hard particulate material, such as tungsten carbide, within a graphite mold and infiltrated with a binder, such as a copper alloy, as also set forth in Cheng. Cast resin-coated sand, graphite displacements or, in some instances, tungsten carbide particles in a flexible polymeric binder, may be employed to define topographic features of the bit. A machinable blank or blanks may be disposed within the bit mold to define the finished shape of the face discharge channels 34 and channel inlets 36 thereof prior to infiltration of the hard particulate material. Such blanks may comprise graphite, steel, or other materials. After hardening of the infiltrant, the blank may be machined away, leaving the face discharge channels 34 and associated channel inlets 36 shaped as desired. Other methods of forming the non-circular shaped face discharge channels 34 and associated channel inlets 36 are also possible in embodiments omitting the sleeve 60. It is to be appreciated that such additional forming methods may be utilized to form bit bodies 10 in embodiments where the sleeve 60 is included, in additional to embodiments where the sleeve 60 is omitted.

Figure 20:
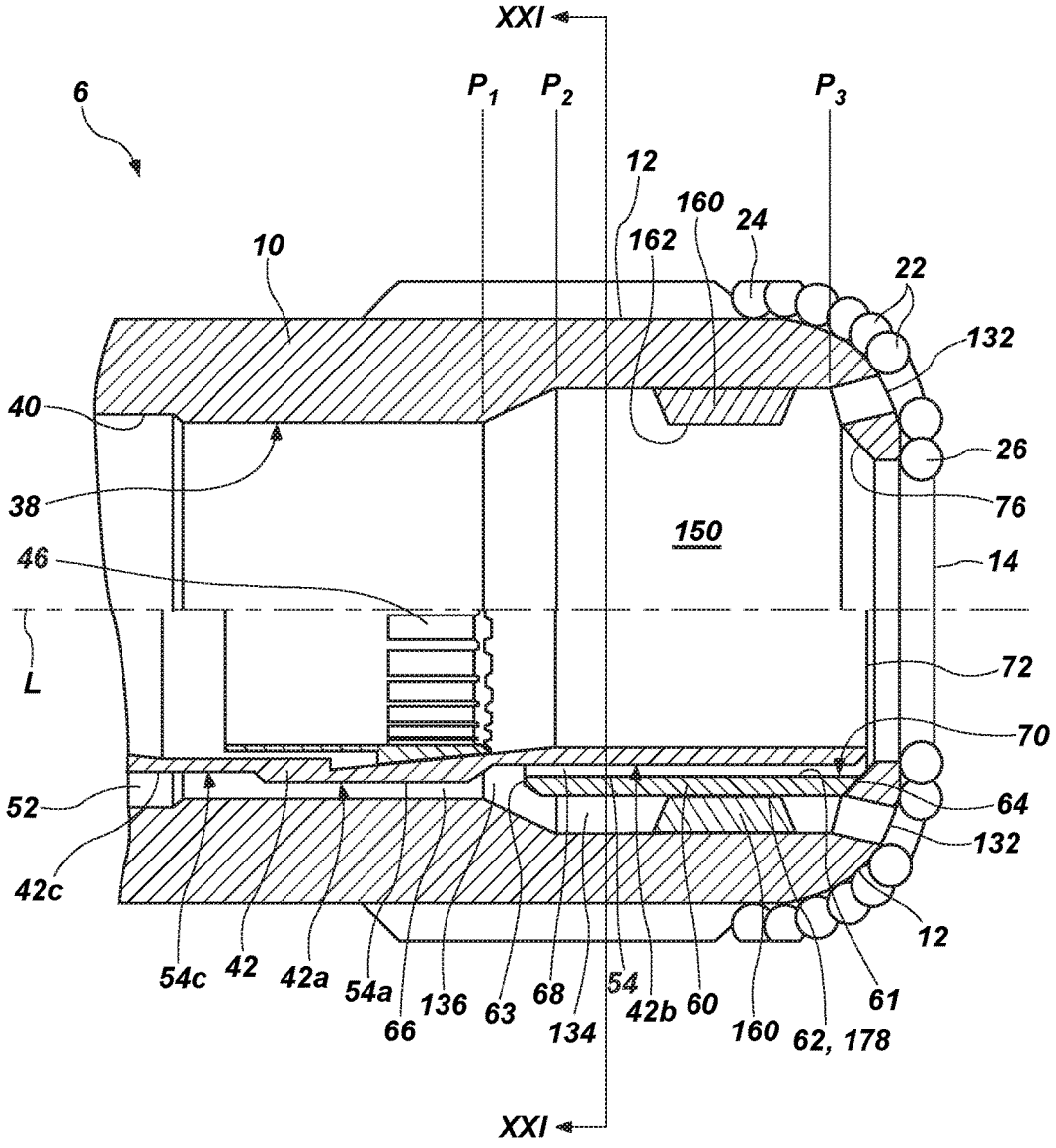
FIG. 20 illustrates a longitudinal cross-sectional view of a core bit, with a partial cross-sectional view of an associated core shoe and sleeve superimposed thereon, wherein the core bit includes an annular, ring-shaped face discharge channel, according to an additional embodiment of the present disclosure.
Figure 21:
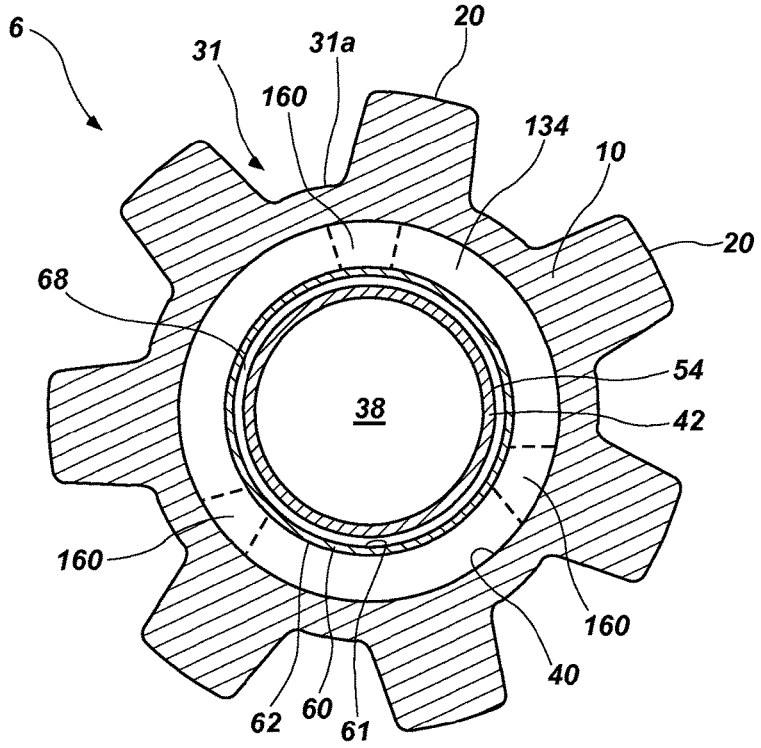
FIG. 21 illustrates a lateral cross-sectional view of the core bit and associated sleeve and core shoe of FIG. 20, taken along line XXI-XXI of FIG. 20.
Figure 22:
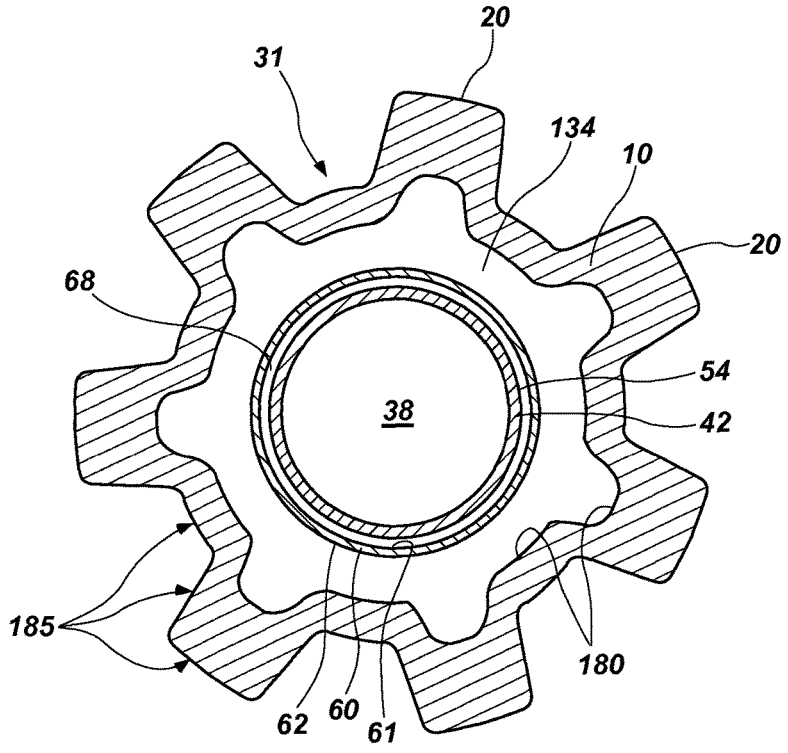
FIG. 22 illustrates a lateral cross-section view of a core bit and associated sleeve and core shoe, wherein the face discharge channel has an outer surface substantially following the outer surface of the bit body, according to an embodiment of the present disclosure.

FIGS. 20-22 illustrate a core bit 6, sleeve 60 and an associated core shoe 42, wherein the core bit 6 has a single, annular, ring-shaped face discharge channel, according to additional embodiments of the present disclosure.

FIG. 20 illustrates superimposed longitudinal cross-sectional views of such a bit body 10 with and without the associated sleeve 60 and core shoe 42 disposed in the cavity 38 of the bit body 10. The bit body 10 and the sleeve 60 of FIG. 20 may be configured similarly to those of FIGS. 1-7; therefore, like components are represented by like reference numbers. The bit body 10 may have an inner cavity 38 extending longitudinally therethrough and bounded by an inner surface 40 of the bit body 10. The cavity 38 may be substantially cylindrical, although other configurations are within the scope of the present disclosure. The cavity 38 of the bit body 10 may be configured to receive a core shoe 42 therein. A single face discharge channel 134 may have an annular shape in a lateral plane and may extend from an inlet 136 of the face discharge channel 134 to a plurality of face discharge outlets 132. An annular reservoir 66 may be located longitudinally upward of the face discharge channel inlet 136 and radially between the inner surface 40 of the bit body 10 and the outer surface 54 of the core shoe 42. Drilling fluid circulating into the annular region 52 collects in the annular reservoir 66, where the drilling fluid can feed into the face discharge channel inlet 136 or the throat discharge channel 68 for delivery to the face surface 12.

A proximal portion of the face discharge channel inlet 136 may be located at a first longitudinal location $P_1$ longitudinally downward of the first portion 42*a* of the core shoe 42 housing the core catcher 46. A diameter of the inner surface 40 of the bit body 10 may gradually increase in a longitudinal direction toward the face surface 12 of the bit body 10 to a second longitudinal location $P_2$, beyond which extends a region 150 of the bit body 10 where the diameter of the inner surface 40 of the bit body 10 remains substantially constant. The radially outer part of the region 150 of the bit body 10 forms the radially outer part of the annular, ring-shaped face discharge channel 134. The annular, ring-shaped face discharge channel 134 effectively terminates at a third longitudinal location $P_3$ proximate the face surface 12 of the bit body 10. The outer contour of the annular, ring-shaped face discharge channel 134 may be formed prior to attachment of the sleeve 60 to the bit body 10. Thus, in the absence of the sleeve 60, the annular, ring-shaped face discharge channel 134 may be machined into the bit body 10 at least partially from the cavity 38 of the bit body 10 via machining methods, such as cutting, milling, turning, grinding, electrochemical machining, eroding, abrading or other formation methods, such as casting, centrifugal casting, additive manufacturing or 3D printing.

A mating portion 76 of the inner surface 40 of the bit body 10 may be located proximate the third longitudinal location $P_3$ and may be configured to receive the bottom end 64 of the sleeve 60, as previously described. The bottom end 64 of the sleeve 60 may be rigidly attached to the mating portion 76 of the inner surface 40 of the bit body 10 by one or more of brazing, shrink fitting, adhesives, or mechanical fastening features, as previously described. The sleeve 60 may also include a torque transmitting feature, such as circumferentially spaced keys on the bottom end 64 of the sleeve 60 extending into like-sized and spaced recesses in the mating portion 76 of the inner surface 40 of the bit body 10. Likewise, torque transmitting elements may be included into the outer surface 62 of the sleeve 60. The sleeve 60 may form a barrier between the annular, ring-shaped face discharge channel 134 located radially outward of the sleeve 60 and the throat discharge channel 68 located radially inward of the sleeve 60, as previously described. A radially inner surface 61 of the sleeve 60 may define at least a portion of a boundary profile 70 of the throat discharge channel 68. Additionally, a radially outer surface 62 of the sleeve 60 may define a radially inner surface 178 of the annular, ring-shaped face discharge channel 134. A longitudinal uppermost end 63 of the sleeve 60 may at least partially define the inlet 136 of the face discharge channel 134. In other embodiments, the sleeve 60 may include fluid passages extending therethrough, as previously described, allowing drilling fluid to flow through the sleeve 60 and into the ring-shaped face discharge channel 134.

The outer surface 62 of the sleeve 60 may have a diameter less than a diameter of all portions of the inner surface 40 of the bit body 10 longitudinally upward of the second longitudinal location of the bit body 10 so that the sleeve 60 may be slid into place as a single, unitary body within the cavity 38 during assembly of the sleeve 60 within the bit body 10. Alternatively, the outer surface 62 of the sleeve 60 may have a diameter greater than a diameter of at least a portion of the inner surface 40 of the bit body 10 longitudinally upward of the second longitudinal location $P_2$ of the bit body 10. In such embodiments, the sleeve 60 may comprise two or more separate circumferential sections that may be assembled in the bit body 10 and disassembled therefrom, as previously described in relation to FIG. 5. Optionally, the sleeve 60 may be loosely maintained in place between the core shoe 42, the bit body 10, and the mating portion 76 of the inner surface of the bit body, wherein the sleeve 60 may be held in place by the downward flow of drilling fluid during operation. With continued reference to FIG. 20, once the sleeve 60 is inserted into its final position, the sleeve 60 may be rigidly affixed to the inner surface 40 of the bit body, as previously described. Furthermore, the sleeve 60 may be configured to be replaceable, as previously described.

The annular, ring-shaped face discharge channel 134 may be in fluid communication with the face discharge outlets 132. The face discharge outlets 132 may be milled or bored from the face surface 12 of the bit body 10 until the face discharge outlets 132 intercept the annular, ring-shaped face discharge channel 134. It is to be appreciated that the face discharge outlets 132 may be formed by other methods, such as cutting, grinding, casting, centrifugal casting, additive manufacturing, 3D printing, or powder metallurgical methods. The face discharge outlets 132 may intercept the face discharge channel 134 at an angle, as shown in FIG. 20, or may extend from the face surface 12 at a direction parallel with the longitudinal axis L of the bit body 10. The face discharge outlets 132 may each be of a conventional, circular shape and optionally include nozzles. In other embodiments, the face discharge outlets 132 have other non-circular shapes in a lateral plane.

With continued reference to FIG. 20, to facilitate accurate insertion of the sleeve 60 through the cavity 38 of the bit body 10 and into place such that the end surface 64 of the sleeve 60 abuts the mating portion 76 of the inner surface 40 of the bit body 10, one or more guide blocks 160 may optionally be affixed to the inner surface 40 of the bit body 10 at one (1) or more circumferential locations between the second and third longitudinal locations $P_2$, $P_3$ of the bit body 10. In additional embodiments, the one (1) or more guide blocks may be helical-shaped. In addition to guiding the sleeve 60 into place during insertion, the guide blocks 160 may also stabilize the sleeve 60 during insertion and operation. One or more recesses (not shown) may be formed in the outer surface of the sleeve 60 and/or into one or more of the guide blocks 160 to guide and stabilize the sleeve 60 during insertion and operation. Each of the optional guide blocks 160 may have an inner surface 162 conforming to the outer surface 62 of the sleeve 60 and may have a radius, measured from the longitudinal axis L of the bit body 10, equivalent to or slightly less than the radius of the outer surface 62 of the sleeve 60, measured from the longitudinal axis L of the bit body 10. The optional guide blocks 160 may be coated with a coating to reduce the effects of friction between the guide blocks 160 and the drilling fluid and/or reduce the effects of erosion of the drilling fluid on the surfaces thereof. The optional guide blocks 160 may be affixed to the inner surface 40 of the bit body 10 by one or more of brazing, shrink fitting, adhesives, mechanical fastening features, or any other suitable means or method as known in the art. In other embodiments, the optional guide blocks 160 may be formed into the inner surface 40 of the bit body 10. In such embodiments, the inner surface 40 of the bit body 10 between the second and third longitudinal locations $P_2$, $P_3$ may be machined, from the cavity 38 of the bit body 10, removing material therefrom in a manner leaving the optional guide blocks 160 extending radially inward from the inner surface 40 of the bit body 10.

FIG. 21 illustrates a lateral cross-sectional view of the core barrel assembly of FIG. 20, taken along line XXI-XXI of FIG. 20. The outer surface 62 of the sleeve 60 may define the radially inward surface of the annular, ring-shaped face discharge channel 134. Optional guide blocks 160 may extend radially inward from the inner surface 40 of the bit body 10, as previously disclosed. It is to be appreciated that while FIG. 21 illustrates three (3) guide blocks 160 evenly spaced about the circumference of the inner surface 40 of the bit body 10, more or less than three (3) guide blocks 160 may be included, and the guide blocks 160 may be unevenly spaced about the circumference of the inner surface 40 of the bit body 10. As depicted, the annular, ring-shaped face discharge channel 134 may be sized to maximize the radial and circumferential dimensions thereof while maintaining necessary wall thicknesses within the bit body 10, including between the face discharge channel 134 and the radial inward-most surface 31*a* of the junk slots 31 to resist formation of cracks or microfractures therein. In additional embodiments, as shown in FIG. 22, a radially outer surface 180 of the face discharge channel 134 may generally conform with an outer surface 185 of the bit body 10. In such embodiments, the radially outer surface 180 of the annular, ring-shaped face discharge channel 134 may extend radially into the blades 20. Such embodiments optimize the radial space of the bit body 10 for enhanced hydraulic performance of the core barrel assembly 2 to divert drilling fluid away from the core sample.

It is to be appreciated that the sleeves 60 and or the core shoes 42 of FIGS. 20-22 may additionally include features for restricting flow of drilling fluid within the throat discharge channel 68, including all the features disclosed in relation to FIGS. 8A-17. For example, the inner surface 61 of the sleeve 60 and/or the outer surface 54*b* of the second portion 42*b* of the core shoe 42 in the throat discharge channel 68 may include recesses formed therein and/or protrusions formed thereon to restrict drilling fluid in the throat discharge channel 68, as previously described. Additionally, the throat discharge channel 68 boundary profile 70 may include one or more stages 90 at which the outer surface 54*b* of the second portion 42*b* of the core shoe 42 and the inner surface 61 of the sleeve 60 abruptly decrease in diameter in the direction of fluid flow to restrict flow of drilling fluid in the throat discharge channel 68, as previously described. In further embodiments, at least portions of the inner surface 61 of the sleeve 60 or the outer surface 54 of the core shoe 42 may be coated with a coating to increase the friction between drilling fluid and at least one of the sleeve 60 and the core shoe 42 and thereby increase the hydraulic losses within the fluid.

The various embodiments of the core bit 6 previously described may include many other features not shown in the figures or described in relation thereto, as some aspects of the core bit 6 may have been omitted from the text and figures for clarity and ease of understanding. Therefore, it is to be understood that the core bit 6 may include many features in addition to those shown in the figures. Furthermore, it is to be further understood that the core bit 6 may not contain all of the features herein described.

Additional, nonlimiting embodiments within the scope of this disclosure include:

Embodiment 1

A coring bit for use on a coring tool for extracting a sample of subterranean formation from a wellbore, comprising: a bit body having a cavity, wherein a throat portion of the cavity extends into the bit body from a face of the bit body; and a sleeve disposed within the cavity of the bit body, the sleeve configured to separate at least one face discharge channel and a throat discharge channel, the at least one face discharge channel located radially outward of the sleeve, the throat discharge channel located radially inward of the sleeve.

Embodiment 2

The coring bit of Embodiment 1, further comprising a coring shoe disposed in the cavity of the bit body.

Embodiment 3

The coring bit of Embodiment 1 or Embodiment 2, wherein the sleeve comprises two or more parts.

Embodiment 4

The coring bit of any one of Embodiments 1 through 3, wherein the sleeve defines at least one recess in a radially inner surface of the sleeve, the at least one recess providing the throat discharge channel with zones of higher and lower flow resistance.

Embodiment 5

The coring bit of any one of Embodiments 1 through 4, wherein the throat discharge channel comprises a first region and a second region, wherein the second region has a total flow area higher than a total flow area of the first region.

Embodiment 6

The coring bit of any one of Embodiments 1 through 5, further comprising one or more guide blocks affixed to an inner surface of the bit body within the cavity, the one or more guide blocks configured to guide the sleeve into place during insertion of the sleeve into the cavity of the bit body or to support the sleeve during operation of the coring bit.

Embodiment 7

The coring bit of any one of Embodiments 1 through 6, wherein the sleeve defines one or more fluid passages extending through the sleeve.

Embodiment 8

The coring bit of any one of Embodiments 1 through 7, wherein at least a portion of a length of the at least one face discharge channel has non-circular cross-sectional shape.

Embodiment 9

The coring bit of Embodiment 8, wherein the portion of the length of the at least one face discharge channel having a non-circular cross-sectional shape comprises about 40% or more of the length of the at least one face discharge channel.

Embodiment 10

The coring bit of Embodiment 8 or Embodiment 9, wherein a total circumferential dimension of the portion of the at least one face discharge channel subtends an angle of at least about 72 degrees about a longitudinal axis of the bit body in a plane transverse to the longitudinal axis of the bit body.

Embodiment 11

The coring bit of any one of Embodiments 8 through 10, wherein a total circumferential dimension of the portion of the at least one face discharge channel subtends an angle of at least about 108 degrees about a longitudinal axis of the bit body in a plane transverse to the longitudinal axis of the bit body.

Embodiment 12

The coring bit of any one of Embodiments 8 through 11, wherein a total circumferential dimension of the portion of the at least one face discharge channel subtends an angle of at least about 144 degrees about a longitudinal axis of the bit body in a plane transverse to the longitudinal axis of the bit body.

Embodiment 13

A method of repairing a coring tool for extracting a sample of subterranean formation from a wellbore, the method comprising: removing a sleeve from a cavity of a bit body of the coring tool, the sleeve configured to separate at least one face discharge channel and a throat discharge channel during operation of the coring tool, the at least one face discharge channel located radially outward of the sleeve, the throat discharge channel located radially inward of the sleeve.

Embodiment 14

The method of Embodiment 13, further comprising: repairing a radially outer surface of the at least one face discharge channel after removing the sleeve; and installing a replacement sleeve into the cavity of the bit body, wherein the replacement sleeve is one of the removed sleeve, a repaired sleeve, and a new sleeve.

Embodiment 15

The method of Embodiment 14, wherein repairing the radially outer surface of the at least one face discharge channel comprises forming at least a portion of the at least one face discharge channel by one or more of a cutting, milling, turning, grinding, eroding, polishing, additive manufacturing, 3D printing, and casting process.

Embodiment 16

The method of any one of Embodiments 13 through 15, wherein the sleeve comprises two or more parts.

Embodiment 17

The method of any one of Embodiments 14 through 16, further comprising installing at least one guide block in the cavity of the bit body prior to installing the replacement sleeve into the cavity of the bit body.

Embodiment 18

The method of any one of Embodiments 14 through 17, further comprising selecting the replacement sleeve according to one or more of a downhole subterranean earth formation, drilling fluid composition, and a drilling fluid flow rate expected during operation of the coring tool.

Embodiment 19

The method of any one of Embodiments 13 through 18, wherein a total circumferential dimension of the at least one face discharge channel subtends an angle of at least about 108 degrees about a longitudinal axis of the bit body in a plane transverse to the longitudinal axis of the bit body.

Embodiment 20

The method of Embodiment 13, further comprising: forming an additional face discharge channel in an inner surface in the bit body after removing the sleeve by one or more of a cutting, milling, turning, grinding, eroding, polishing, additive manufacturing, 3D printing, and casting process; and installing a replacement sleeve into the cavity of the bit body, wherein the replacement sleeve is one of a repaired sleeve and a new sleeve.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. A coring bit for use on a coring tool for extracting a sample of subterranean formation from a wellbore, comprising:

a bit body having a cavity, wherein a throat portion of the cavity extends into the bit body from a face of the bit body; and a sleeve disposed within the cavity of the bit body, the sleeve configured to separate at least one face discharge channel and a throat discharge channel, the at least one face discharge channel located radially outward of the sleeve and extending through the bit body, at least a portion of the at least one face discharge channel being defined by an inner surface of the bit body, the throat discharge channel located radially inward of the sleeve, wherein at least a portion of a length of the at least one face discharge channel has a non-circular cross-sectional shape.

2. The coring bit of claim 1, further comprising a coring shoe disposed in the cavity of the bit body.

3. The coring bit of claim 1, wherein the sleeve comprises two or more parts.

4. The coring bit of claim 1, wherein the sleeve defines at least one recess in a radially inner surface of the sleeve, the at least one recess providing the throat discharge channel with zones of higher and lower flow resistance.

5. The coring bit of claim 1, wherein the throat discharge channel comprises a first region and a second region, wherein the second region has a total flow area higher than a total flow area of the first region.

6. The coring bit of claim 1, further comprising one or more guide blocks affixed to an inner surface of the bit body within the cavity, the one or more guide blocks configured to guide the sleeve into place during insertion of the sleeve into the cavity of the bit body or to support the sleeve during operation of the coring bit.

7. The coring bit of claim 1, wherein the sleeve defines one or more fluid passages extending through the sleeve.

8. The coring bit of claim 1, wherein the portion of the length of the at least one face discharge channel having the non-circular cross-sectional shape comprises about 40% or more of the length of the at least one face discharge channel.

9. The coring bit of claim 1, wherein a total circumferential dimension of the portion of the at least one face discharge channel subtends an angle of at least about 72 degrees about a longitudinal axis of the bit body in a plane transverse to the longitudinal axis of the bit body.

10. The coring bit of claim 9, wherein a total circumferential dimension of the portion of the at least one face discharge channel subtends an angle of at least about 108 degrees about a longitudinal axis of the bit body in a plane transverse to the longitudinal axis of the bit body.

11. The coring bit of claim 10, wherein a total circumferential dimension of the portion of the at least one face discharge channel subtends an angle of at least about 144 degrees about a longitudinal axis of the bit body in a plane transverse to the longitudinal axis of the bit body.

12. A method of repairing a coring tool for extracting a sample of subterranean formation from a wellbore, the method comprising:

removing a sleeve from a cavity of a bit body of the coring tool, the sleeve configured to separate at least one face discharge channel and a throat discharge channel during operation of the coring tool, the at least one face discharge channel located radially outward of the sleeve and extending through the bit body, at least a portion of the at least one face discharge channel being defined by an inner surface of the bit body, the throat discharge channel located radially inward of the sleeve, wherein at least a portion of a length of the at least one face discharge channel has a non-circular cross-sectional shape.

13. The method of claim 12, further comprising:

repairing a radially outer surface of the at least one face discharge channel after removing the sleeve; and installing a replacement sleeve into the cavity of the bit body, wherein the replacement sleeve is one of the removed sleeve, a repaired sleeve, and a new sleeve.

14. The method of claim 13, wherein repairing the radially outer surface of the at least one face discharge channel comprises forming at least a portion of the at least one face discharge channel by one or more of a cutting, milling, turning, grinding, eroding, polishing, additive manufacturing, 3D printing, and casting process.

15. The method of claim 13, wherein the sleeve comprises two or more parts.

16. The method of claim 13, further comprising installing at least one guide block in the cavity of the bit body prior to installing the replacement sleeve into the cavity of the bit body.

17. The method of claim 13, further comprising selecting the replacement sleeve according to one or more of a downhole subterranean earth formation, drilling fluid composition, and a drilling fluid flow rate expected during operation of the coring tool.

18. The method of claim 12, wherein a total circumferential dimension of the at least one face discharge channel subtends an angle of at least about 108 degrees about a longitudinal axis of the bit body in a plane transverse to the longitudinal axis of the bit body.

19. The method of claim 12, further comprising:

forming an additional face discharge channel in an inner surface in the bit body after removing the sleeve by one or more of a cutting, milling, turning, grinding, eroding, polishing, additive manufacturing, 3D printing, and casting process; and installing a replacement sleeve into the cavity of the bit body, wherein the replacement sleeve is one of a repaired sleeve and a new sleeve.

* * * * *